US012127670B2

(12) United States Patent
Nance et al.

(10) Patent No.: US 12,127,670 B2
(45) Date of Patent: Oct. 29, 2024

(54) CABINET STORAGE ASSEMBLY

(71) Applicant: PAN PANTRY LLC, Albuquerque, NM (US)

(72) Inventors: Christopher Nance, Albuquerque, NM (US); Linda Joy Kegel, Albuquerque, NM (US); Jesse James Hahn, Cedar Rapids, IA (US)

(73) Assignee: PAN PANTRY LLC, Albuquerque, NM (US)

( * ) Notice: Subject to any disclaimer, the term of this patent is extended or adjusted under 35 U.S.C. 154(b) by 453 days.

(21) Appl. No.: 17/359,062

(22) Filed: Jun. 25, 2021

(65) Prior Publication Data

US 2021/0401167 A1 Dec. 30, 2021

Related U.S. Application Data

(60) Provisional application No. 63/045,008, filed on Jun. 26, 2020.

(51) Int. Cl.

| | |
|---|---|
| ***A47B 57/34*** | (2006.01) |
| ***A47B 47/02*** | (2006.01) |
| ***A47B 47/04*** | (2006.01) |
| ***A47B 77/04*** | (2006.01) |
| ***A47B 87/02*** | (2006.01) |

(52) U.S. Cl.

CPC ..... *A47B 57/34* (2013.01); *A47B 47/025* (2013.01); *A47B 47/042* (2013.01); *A47B 77/04* (2013.01); *A47B 87/0253* (2013.01)

(58) Field of Classification Search

CPC ..... A47B 57/34; A47B 47/025; A47B 47/042; A47B 87/0253; A47B 87/0276; A47B 88/417

See application file for complete search history.

(56) References Cited

U.S. PATENT DOCUMENTS

| | | | | | |
|---|---|---|---|---|---|
| 1,833,081 | A | * | 11/1931 | Kilmer | B65D 25/06 312/351 |
| 2,306,802 | A | * | 12/1942 | Harbison | F25D 25/024 312/334.7 |
| 2,360,451 | A | * | 10/1944 | Stone | A47B 43/02 312/265.5 |
| 2,547,463 | A | * | 4/1951 | Haut | A47B 88/483 312/351 |
| 3,087,764 | A | * | 4/1963 | Schless | A47B 88/417 312/351 |
| 3,097,901 | A | * | 7/1963 | Schless | A47B 57/08 312/330.1 |

(Continued)

FOREIGN PATENT DOCUMENTS

| | | | |
|---|---|---|---|
| CH | 262759 A | * | 7/1949 |
| DE | 2329016 A1 | * | 1/1975 |

(Continued)

*Primary Examiner* — Stanton L Krycinski

(74) *Attorney, Agent, or Firm* — LOZA & LOZA, LLP; Kevin L. Soules

(57) ABSTRACT

A storage assembly comprising at least one storage body comprising the storage body including a first side wall, a second side wall, an end wall, and at least two grooves along the inner surface of the storage assembly, the grooves being substantially coplanar and at least one shelf configured to fit inside the storage body along the substantially coplanar grooves and into the end wall coplanar grooves.

7 Claims, 18 Drawing Sheets

(56) References Cited

U.S. PATENT DOCUMENTS 3,379,483 A * 4/1968 Oldford ..... A47B 47/042 312/263
3,515,450 A * 6/1970 Jaecke ..... A47B 47/0075 312/209
3,722,971 A * 3/1973 Zeischegg ..... A47B 87/0276 312/109
3,779,623 A * 12/1973 Motohashi ..... A47B 47/0075 312/111
3,918,781 A * 11/1975 Paris ..... A47B 87/0207 312/334.44
4,021,089 A * 5/1977 Bush ..... F16B 12/26 312/265.5
4,082,389 A * 4/1978 Stewart ..... A47B 47/042 312/258
4,120,551 A * 10/1978 Godtschalck ..... A47B 88/941 220/691
4,125,304 A * 11/1978 Ebert ..... A47B 47/042 312/111
4,171,150 A * 10/1979 Soderlund ..... A47B 96/00 312/265.5
4,238,044 A * 12/1980 Roddier ..... B65D 11/1873 220/675
4,502,741 A * 3/1985 DeVries ..... A47F 3/063 312/334.44
4,664,283 A * 5/1987 Liu ..... F16B 12/26 220/23.6
4,739,887 A * 4/1988 Beach ..... A47B 81/06 211/26.1
4,782,972 A * 11/1988 Wenkman ..... B42F 7/10 312/263
4,856,434 A * 8/1989 Smith ..... A47B 87/00 108/180
4,950,039 A * 8/1990 Helling ..... A47B 67/04 312/249.11
5,031,974 A * 7/1991 Feucht ..... A47B 47/025 312/263
5,048,902 A * 9/1991 Daly ..... B62B 3/006 312/249.8
5,147,120 A * 9/1992 Ray ..... A47B 61/00 312/107
5,360,263 A * 11/1994 Nakano ..... A47B 47/0075 403/231
5,372,415 A * 12/1994 Tisbo ..... A47B 61/00 403/231
5,466,058 A * 11/1995 Chan ..... A47B 95/02 312/109
5,501,354 A * 3/1996 Stromberg ..... B65D 1/225 220/7
5,746,333 A * 5/1998 Wuertemberger ..... A47B 47/0041 211/189
5,975,660 A * 11/1999 Tisbo ..... A47B 47/045 312/265.2
6,113,203 A * 9/2000 Chen ..... B25H 3/00 312/258
6,126,022 A * 10/2000 Merkel ..... A47B 47/042 211/186
6,193,340 B1 * 2/2001 Schenker ..... A47B 47/0075 312/265.5
6,409,037 B1 * 6/2002 Lin ..... E05D 7/1011 220/23.8
6,474,759 B2 * 11/2002 Hsu ..... F16B 12/26 312/263
6,557,709 B2 * 5/2003 Broome ..... H05K 7/186 211/183
6,612,078 B2 * 9/2003 Hawang ..... F16B 12/12 52/36.5
6,820,950 B1 * 11/2004 Sun ..... A47B 47/042 312/263
6,824,232 B2 * 11/2004 Farmer ..... A47B 88/402 312/348.3
RE38,707 E * 3/2005 Merkel ..... F16B 12/24 211/186
6,991,115 B2 * 1/2006 Chow ..... G11B 33/0483 211/188
7,159,730 B2 * 1/2007 Rumpel ..... B65D 11/1833 220/23.6
7,306,299 B2 * 12/2007 Wells ..... A47B 47/042 312/265.5
7,866,769 B2 * 1/2011 Ahlgrim ..... F16B 12/46 312/265.5
7,914,091 B1 * 3/2011 Joyce ..... A47B 47/042 108/193
7,998,549 B2 * 8/2011 Susnjara ..... A47B 67/04 29/466
8,113,600 B2 * 2/2012 Zalewski ..... A47B 47/0041 312/107
8,388,073 B2 * 3/2013 Richter ..... A47B 47/025 312/263
8,424,689 B2 * 4/2013 McConnell ..... A47F 5/0018 211/13.1
8,590,976 B2 * 11/2013 Davis ..... A47C 4/021 297/440.13
8,621,739 B1 * 1/2014 Elliot ..... A63H 33/084 29/428
8,622,489 B2 * 1/2014 Crabtree, II ..... F16B 12/02 312/265.5
8,651,593 B2 * 2/2014 Bezich ..... B65D 5/68 312/259
8,757,917 B2 * 6/2014 Andersson ..... F16B 12/125 403/252
9,398,806 B2 * 7/2016 Mitchell ..... A47B 47/042
9,526,330 B2 * 12/2016 Weijian ..... A47B 47/0075
9,526,333 B1 * 12/2016 Nielson ..... A47B 87/0292
9,661,920 B2 * 5/2017 Ahart ..... A47B 57/08
9,981,677 B1 * 5/2018 Gross ..... B62B 3/025
10,085,553 B2 * 10/2018 Fünfgeld ..... A47B 47/00
10,172,484 B2 * 1/2019 Maldonado ..... A47F 7/06
10,415,612 B2 * 9/2019 Davis ..... F16B 12/00
10,415,613 B2 * 9/2019 Boo ..... A47B 88/941
10,744,419 B2 * 8/2020 Xia ..... B65D 11/1873
10,881,199 B1 * 1/2021 Le ..... A47B 88/402
10,960,910 B1 * 3/2021 Garcia ..... B62B 3/02
11,154,137 B2 * 10/2021 Davis ..... A47C 4/021
11,497,325 B2 * 11/2022 Peters ..... A47F 1/12
2002/0063100 A1 * 5/2002 Kwang ..... G11B 33/0483 211/41.12
2002/0109442 A1 * 8/2002 Hsu ..... A47B 47/042 312/263
2004/0178704 A1 * 9/2004 Saravis ..... F16B 12/38 312/111
2006/0175945 A1 * 8/2006 Deguchi ..... A47B 47/0075 312/257.1
2007/0051721 A1 * 3/2007 Wu ..... B65D 21/0201 220/23.6
2007/0252496 A1 * 11/2007 Remondino ..... A47B 88/417 312/351
2010/0326941 A1 * 12/2010 Rosenblum ..... F16B 12/26 211/188
2012/0133253 A1 * 5/2012 Bergevin ..... A47B 47/042 312/204
2013/0048632 A1 * 2/2013 Chen ..... B65D 9/24 220/4.33
2014/0030017 A1 * 1/2014 Luo ..... F16B 12/20 403/375
2014/0048176 A1 * 2/2014 Susnjara ..... F16B 12/125 312/257.1
2015/0144578 A1 * 5/2015 Maiden ..... A47B 47/025 211/26
2019/0248540 A1 * 8/2019 Conti ..... A47F 3/005

FOREIGN PATENT DOCUMENTS

DE 9419199 U1 * 3/1995
DE 29506782 U1 * 8/1995
DE 29507679 U1 * 9/1995
DE 202014103446 U1 * 10/2014 ..... A47B 47/042

(56) References Cited

FOREIGN PATENT DOCUMENTS

| | | | | | |
|---|---|---|---|---|---|
| DE | 102019206740 | A1 | * | 11/2020 | |
| EP | 2883477 | B1 | * | 8/2016 | ..... A47B 47/042 |
| FR | 1562067 | A | * | 4/1969 | |
| FR | 2332721 | A1 | * | 6/1977 | |
| FR | 2409027 | A1 | * | 6/1979 | |
| FR | 2497646 | A1 | * | 7/1982 | |
| FR | 2832300 | A1 | * | 5/2003 | ..... A47B 47/042 |
| GB | 2507241 | A | * | 4/2014 | ..... A47B 47/0066 |
| KR | 20130026010 | A | * | 3/2013 | |
| WO | WO-2004069003 | A1 | * | 8/2004 | ..... A47B 47/042 |
| WO | WO-2013164179 | A1 | * | 11/2013 | ..... A47B 96/024 |

* cited by examiner

CABINET STORAGE ASSEMBLY

CROSS REFERENCE TO RELATED PATENT APPLICATIONS

This patent application claims the priority and benefit under 35 U.S.C. § 119(e) of U.S. Provisional Patent Application Ser. No. 63/045,008 filed Jun. 26, 2020, entitled "CABINET STORAGE ASSEMBLY." U.S. Provisional Patent Application Ser. No. 63/045,008 is herein incorporated by reference in its entirety.

TECHNICAL FIELD

Embodiments are generally related to the field of storage. Embodiments are further related to the use of organizational systems to store items in cabinets. Embodiments are further related to methods, systems, and apparatuses for efficient storage of large bakeware such as pans and platters while maximizing use of cabinet space.

BACKGROUND

Most cabinetry is not well suited for storing all of the equipment commonly used in a modern kitchen. Cabinets are generally designed in cuboid shapes with large void spaces therein. These spaces are convenient for storing large appliances or high volume pots. However, for generally flatter kitchen equipment, like pans or platters, the space is inefficient. In particular, a few of the generally flat items can be set on the floor of the cabinet leaving the rest of the cabinet empty, or requiring other items to be stacked on top of the flat items. This arrangement is either inefficient or inconvenient, and in some cases both.

Other cabinet arrangements may include fixed shelves one above the other. This style cabinet is often a wall mounted unit that is not deep enough to store platters, pans, or other similar kitchenware. In addition, the spacing between the shelving is either fixed, or inconvenient to adjust. Other solutions include custom fitted shelving which is expensive to purchase and install and often is not adjustable.

These and other issues render current storage solutions for cabinetry inefficient in utilizing the available space, prohibitively expensive, or overly inconvenient. As such, there is a need in the art for improved storage solutions as detailed in the embodiments presented herein.

SUMMARY

The following summary is provided to facilitate an understanding of some of the innovative features unique to the embodiments disclosed and is not intended to be a full description. A full appreciation of the various aspects of the embodiments can be gained by taking the entire specification, claims, drawings, and abstract as a whole.

It is, therefore, one aspect of the disclosed embodiments to provide storage systems and apparatuses.

It is another aspect of the disclosed embodiments to provide adjustable storage systems and apparatuses.

It is another aspect of the disclosed embodiments to provide modular storage systems and apparatuses.

It is another aspect of the disclosed embodiments to provide adjustable kitchenware storage configured to make use of large unused spaces in cabinets.

It is another aspect of the disclosed embodiments to provide methods, systems, and apparatuses for efficient storage of large bakeware, such as pans and platters, while maximizing use of cabinet space.

It will be appreciated that the methods and systems can be achieved according to the embodiments disclosed herein. For example in an embodiment a storage apparatus comprises at least one storage body comprising a first side wall, the first side wall comprising at least two grooves along an inner surface of the first side wall; a lower connection groove formed below the at least two grooves, and an upper connection groove formed above the at least two grooves; a second side wall, the second side wall comprising at least two grooves along an inner surface of the second side wall; a lower connection groove formed on the inner surface of the second side wall and below the at least two grooves, and an upper connection groove formed on the inner surface of the second side wall and above the at least two grooves; an end wall, the end wall comprising at least two grooves along an inner surface of the end wall; an upper male connection peg extending from both ends of the end wall and configured to fit in the upper connection groove of the first side wall and the upper connection groove of the second side wall respectively; and a lower male connection peg extending from both ends of the end wall and configured to fit in the lower connection groove of the first side wall and the lower connection groove of the second side wall respectively; wherein each of the at least two grooves along the inner surface of the first side wall, the at least two inner grooves along the inner surface of the second side wall; and the at least two inner grooves along the inner surface of the end wall are substantially coplanar; and at least one shelf configured to fit inside the storage body along the substantially coplanar grooves along the inner surface of the first side wall, the grooves along the inner surface of the second side wall; and the grooves along the inner surface of the end wall.

BRIEF DESCRIPTION OF THE FIGURES

The accompanying figures, in which like reference numerals refer to identical or functionally-similar elements throughout the separate views and which are incorporated in and form a part of the specification, further illustrate the embodiments and, together with the detailed description, serve to explain the embodiments disclosed herein.

DETAILED DESCRIPTION

Figure 1:
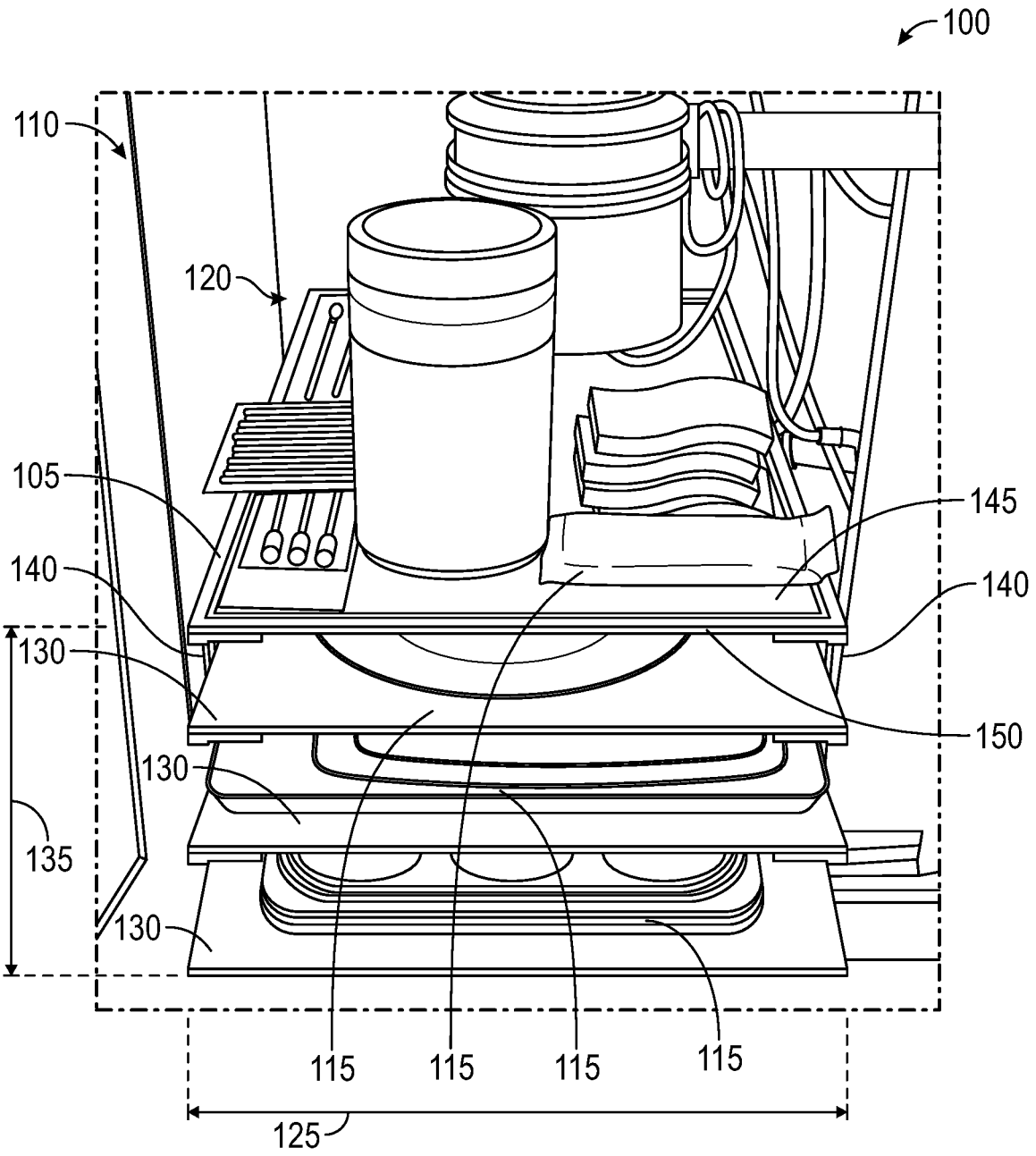
FIG. 1 depicts a modular storage apparatus, in accordance with the disclosed embodiments.
Figure 2A:
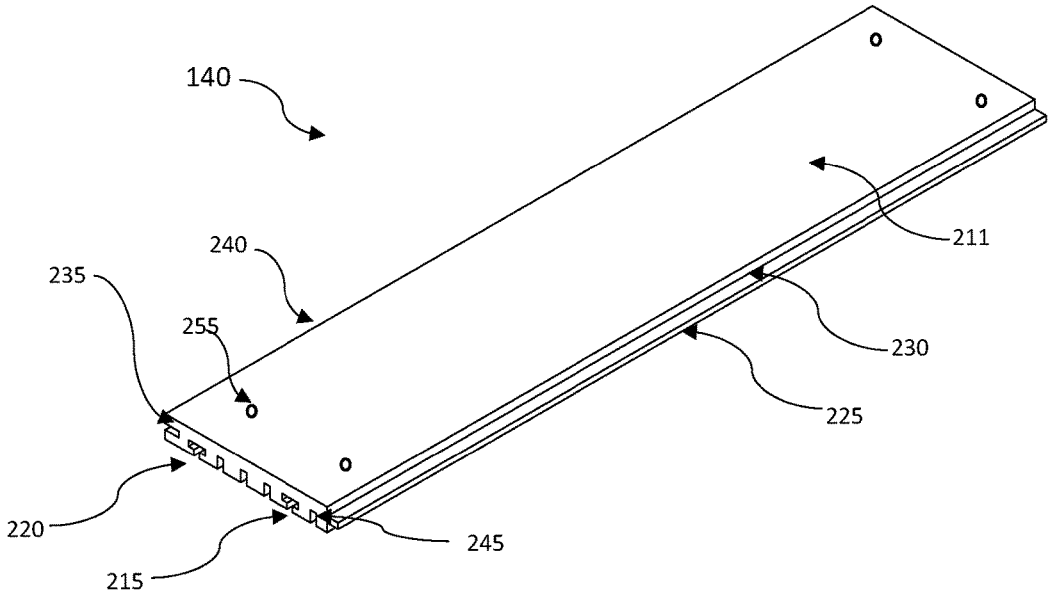
FIG. 2A depicts a perspective view of a side wall associated with a storage apparatus, in accordance with the disclosed embodiments.
Figure 2B:
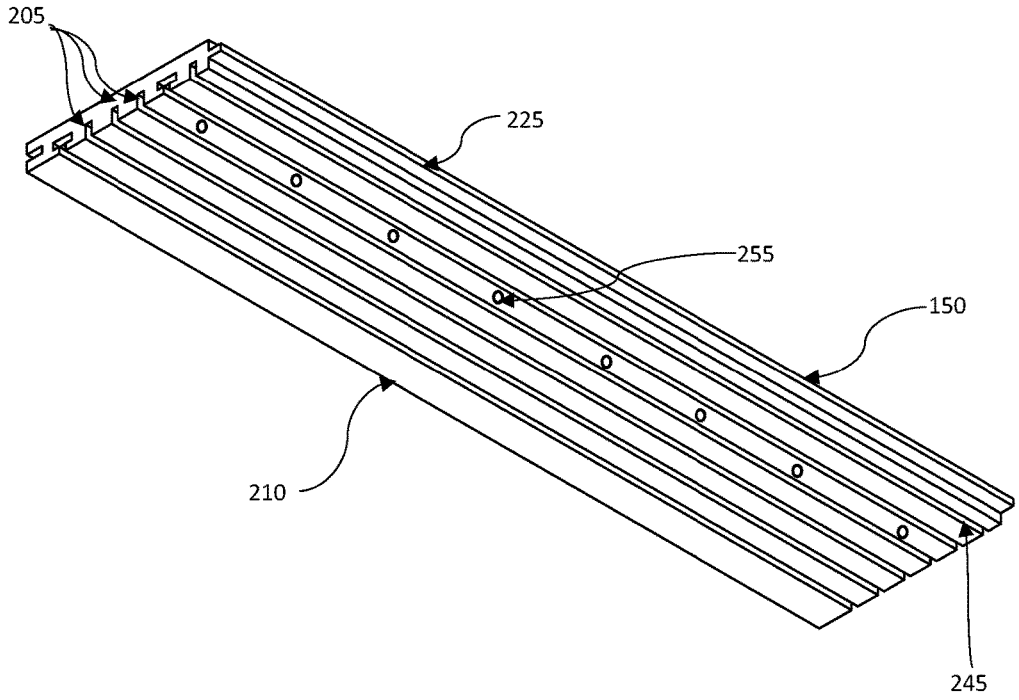
FIG. 2B depicts a perspective view of an inner side wall associated with a storage apparatus, in accordance with the disclosed embodiments.
Figure 2C:
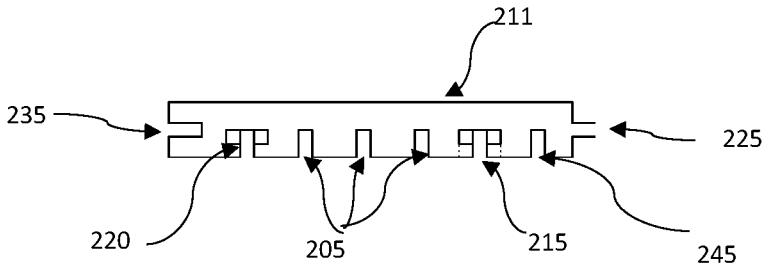
FIG. 2C depicts an elevation view of a distal end of a side wall associated with a storage apparatus, in accordance with the disclosed embodiments.
Figure 2D:
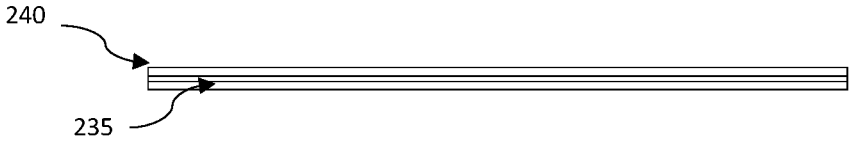
FIG. 2D depicts an elevation view of a bottom edge of a side wall associated with a storage apparatus, in accordance with the disclosed embodiments.
Figure 2E:
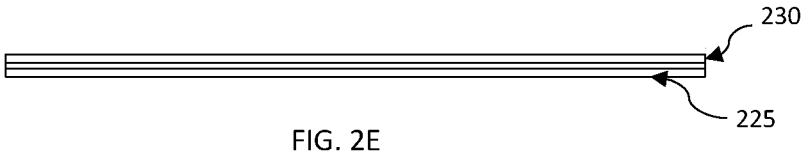
FIG. 2E depicts an elevation view of a top edge of a side wall associated with a storage apparatus, in accordance with the disclosed embodiments.
Figure 2F:
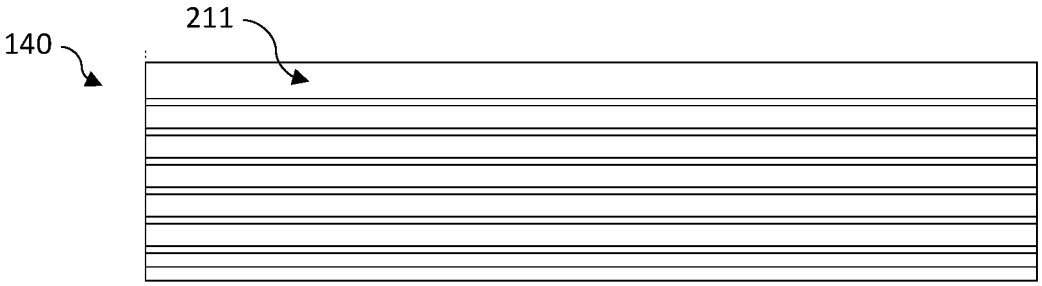
FIG. 2F depicts an elevation view of an inside of a side wall associated with a storage apparatus, in accordance with the disclosed embodiments.
Figure 3A:
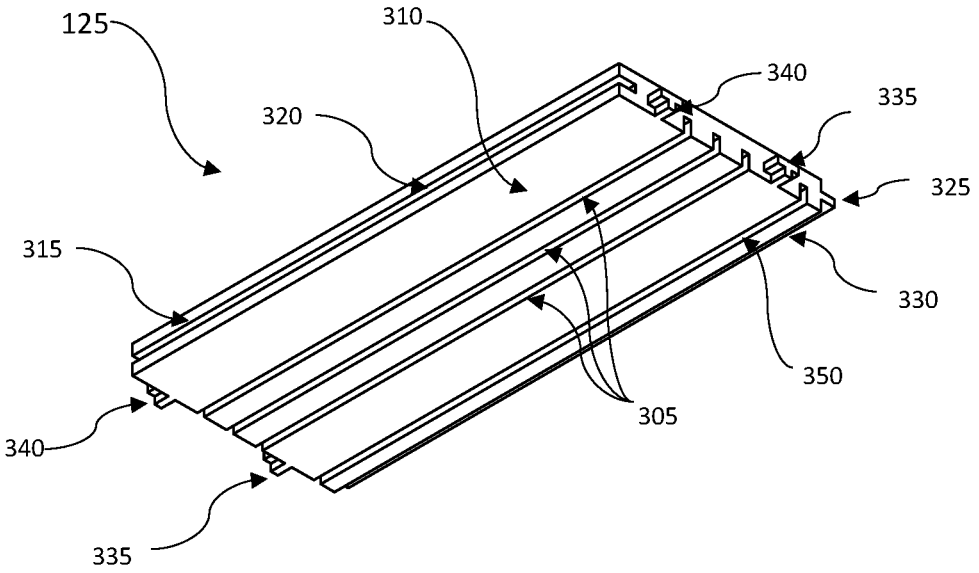
FIG. 3A depicts a perspective view of an end wall associated with a storage apparatus, in accordance with the disclosed embodiments.
Figure 3B:
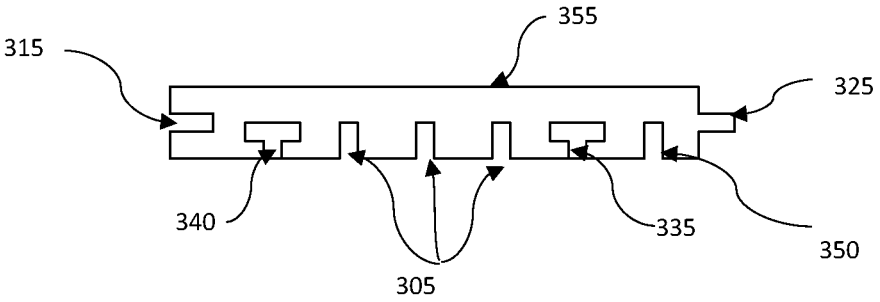
FIG. 3B depicts an elevation view of a distal end of an end wall associated with a storage apparatus, in accordance with the disclosed embodiments.
Figure 3C:
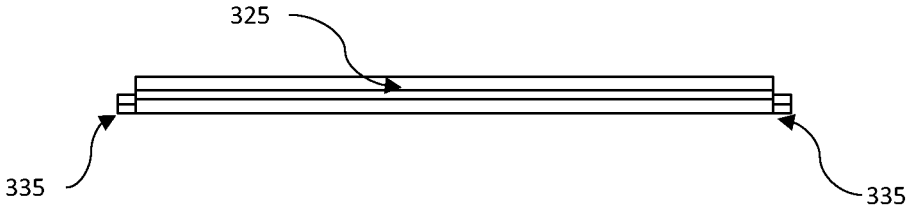
FIG. 3C depicts an elevation view of a bottom edge of an end wall associated with a storage apparatus, in accordance with the disclosed embodiments.
Figure 3D:
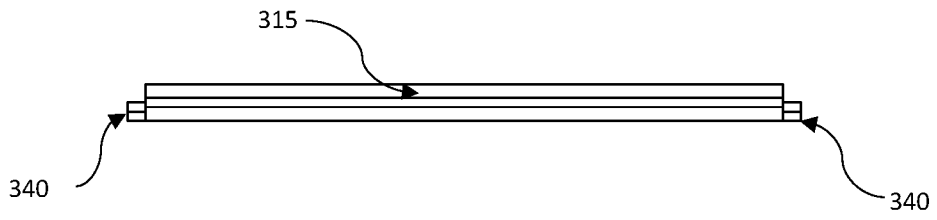
FIG. 3D depicts an elevation view of a top edge of an end wall associated with a storage apparatus, in accordance with the disclosed embodiments.
Figure 3E:
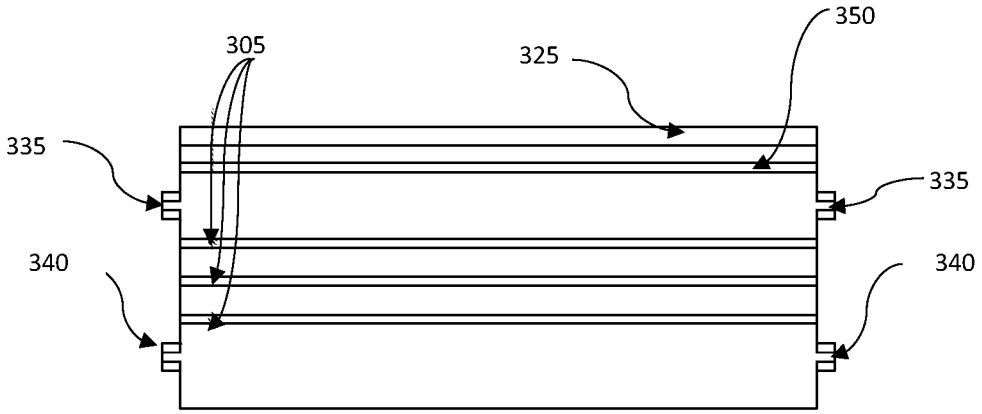
FIG. 3E depicts an elevation view of an inside of an end wall associated with a storage apparatus, in accordance with the disclosed embodiments.

The particular values and configurations discussed in the following non-limiting examples can be varied, and are cited merely to illustrate one or more embodiments, and are not intended to limit the scope thereof.

Example embodiments will now be described more fully hereinafter, with reference to the accompanying drawings, in which illustrative embodiments are shown. The embodiments disclosed herein can be embodied in many different forms and should not be construed as limited to the embodiments set forth herein; rather, these embodiments are provided so that this disclosure will be thorough and complete, and will fully convey the scope of the embodiments to those skilled in the art. Like numbers refer to like elements throughout.

The terminology used herein is for the purpose of describing particular embodiments only and is not intended to be limiting. As used herein, the singular forms "a", "an", and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Throughout the specification and claims, terms may have nuanced meanings suggested or implied in context beyond an explicitly stated meaning. Likewise, the phrase "in one embodiment" as used herein does not necessarily refer to the same embodiment and the phrase "in another embodiment" as used herein does not necessarily refer to a different embodiment. It is intended, for example, that claimed subject matter include combinations of example embodiments in whole or in part.

Unless otherwise defined, all terms (including technical and scientific terms) used herein have the same meaning as commonly understood by one of ordinary skill in the art. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

It is contemplated that any embodiment discussed in this specification can be implemented with respect to any method, kit, reagent, or composition of the invention, and vice versa. Furthermore, compositions of the invention can be used to achieve methods of the invention.

It will be understood that particular embodiments described herein are shown by way of illustration and not as limitations of the invention. The principal features of this invention can be employed in various embodiments without departing from the scope of the invention. Those skilled in the art will recognize, or be able to ascertain using no more than routine experimentation, numerous equivalents to the specific procedures described herein. Such equivalents are considered to be within the scope of this invention and are covered by the claims.

The use of the word "a" or "an" when used in conjunction with the term "comprising" in the claims and/or the specification may mean "one," but it is also consistent with the meaning of "one or more," "at least one," and "one or more than one." The use of the term "or" in the claims is used to mean "and/or" unless explicitly indicated to refer to alternatives only or the alternatives are mutually exclusive, although the disclosure supports a definition that refers to only alternatives and "and/or." Throughout this application, the term "about" is used to indicate that a value includes the inherent variation of error for the device, the method being employed to determine the value, or the variation that exists among the study subjects.

As used in this specification and claim(s), the words "comprising" (and any form of comprising, such as "comprise" and "comprises"), "having" (and any form of having, such as "have" and "has"), "including" (and any form of including, such as "includes" and "include") or "containing" (and any form of containing, such as "contains" and "contain") are inclusive or open-ended and do not exclude additional, unrecited elements or method steps.

The term "or combinations thereof" as used herein refers to all permutations and combinations of the listed items preceding the term. For example, "A, B, C, or combinations thereof" is intended to include at least one of: A, B, C, AB, AC, BC, or ABC, and if order is important in a particular context, also BA, CA, CB, CBA, BCA, ACB, BAC, or CAB. Continuing with this example, expressly included are combinations that contain repeats of one or more item or term, such as BB, AAA, AB, BBC, AAABCCCC, CBBAAA, CABABB, and so forth. The skilled artisan will understand that typically there is no limit on the number of items or terms in any combination, unless otherwise apparent from the context.

All of the compositions and/or methods disclosed and claimed herein can be made and executed without undue experimentation in light of the present disclosure. While the compositions and methods of this invention have been described in terms of preferred embodiments, it will be apparent to those of skill in the art that variations may be applied to the compositions and/or methods and in the steps or in the sequence of steps of the method described herein without departing from the concept, spirit and scope of the invention. All such similar substitutes and modifications apparent to those skilled in the art are deemed to be within the spirit, scope and concept of the invention as defined by the appended claims.

FIG. 1 illustrates a storage apparatus 100 in accordance with the disclosed embodiments. As illustrated in FIG. 1, the storage apparatus 100 generally comprises a storage body 105 dimensionally configured to fit in a cabinet 110 which can comprise a standard kitchen cabinet, bathroom cabinet, cupboard, or other storage enclosure. In certain embodiments, the storage apparatus 100 can be specifically designed for a standard 18", 24", or 36" cabinet 110 and creates a faux bottom to the cabinet 110. The faux bottom raises the products 115 stored on the storage apparatus 100.

In certain embodiments, the dimensions of the storage apparatus 100 can be modifiable in incremented predetermined sizes. For example, changes to the width 120 of the storage apparatus 100 end wall 120 also requires a change in size of the shelves 130. In certain embodiments, the storage apparatus 100 can come in several predetermined sizes, specifically designed for a standard 12", 15", 18", 24", or 36" cabinet 110. The width 125 of the storage assembly 100 can also be made between 18" and 36" as the entire width 125 may not be desired in larger cabinet designs. The height 135 of the storage assembly 100 can be expanded up to the maximum height of the cabinet 110. In an exemplary embodiment the height can be adjustable in 1" increments by forming a groove in 1 inch increments along sidewall 140. The total height can also be adjusted by staking as the disclosed embodiments are configured to be modular and one can be stacked on top of another.

Aspects of the disclosed embodiments, including the side walls 140, can be made from extruded plastic. The shelves 130 can be cut from plastic sheets. Material selections can be adjusted to account for weight and price preferences. In certain embodiments, plastic may be preferable because it is a cheap and lightweight and has resistance to water and chemical damage. In certain embodiments, extrusion molding can be used to manufacture various parts of the storage assembly 100. In certain embodiments, aspects of the storage assembly 100 can be made of treated, manufactured, or engineered wood, metals, and/or other coated metals.

The storage body 105 can be formed with grooves along the internal surfaces to hold a series of shelves 130 as further detailed herein. The shelves 130 are configured to slide in and out of the storage body 105 providing access to stored items 115 (e.g., pans, platters, plates, trays, sponges, towels, etc.) that can be stored thereon. In certain embodiments, the storage body 105 can have a longer depth dimension, than width dimension as is required to fit in most cabinets. In other embodiments, other dimensional characteristics are possible.

The body can include a first side wall and a second side wall 140. Aspects of the side walls 140 are illustrated in FIGS. 2A-2F. The lengths of the side walls 140 define the depth of the storage body 105. The first side wall 140 can comprise at least two, and optionally three or more, shelf grooves 205 along its inner surface 210. The shelf grooves 205 are configured to accept a shelf 130.

The first side wall 140 can include a lower connection groove 215 formed below the at least two shelf grooves 205, and an upper connection groove 220 formed above the at least two shelf grooves 205.

Likewise, the storage body 105 can additionally include a second side wall 140, comprising at least two, and optionally three or more, shelf grooves 205 along its inner surface 210. The outer surface 211 can be substantially smooth. These shelf grooves 205 are configured to accept a shelf 130. The second side wall 140 can include a lower connection groove 215 formed below the at least two shelf grooves 205, and an upper connection groove 220 formed above the at least two shelf grooves 205. In the exemplary embodiment, illustrated herein, the side walls 140 can be longer than the end wall 120.

The side walls 140 can further be configured with a stacking edge 225 along the top edge 230 of the side wall 140, and a stacking groove 235 along the bottom edge 240 of the side wall 140. The stacking edge 225 is configured to fit into the stacking groove 235 so that one side wall 140 can be stacked on top of another side wall 140. In this way the storage body 105 can be modular.

The storage body 105 can further include an end wall 120 as illustrated in FIGS. 3A-3E. The length of the end wall 120 defines the width of the storage body 105, as it fits in between the two side walls 140. The outside surface 355 of the end wall can be substantially smooth. The end wall 120 can include at least two shelf grooves 305, and optionally three or more shelf grooves 305, along an inner surface 310 of the end wall 120. The shelf grooves 305 can also be configured to accept a shelf 130. It should be noted that the end wall 120 includes a lower connection groove 315 formed along the bottom edge 320 and an upper connection ridge 325 formed on the top surface 330 of the end wall 120.

The shelf grooves 205 in the sidewalls 140 and shelf grooves 305 in the end wall 120 which are configured to accept a shelf 130 that can be configured so that they are substantially coplanar, with the two other respective grooves. The storage body 105 thus includes one or more series of substantially coplanar grooves so that a series of shelves 130 can be inserted into each of the sets of grooves forming a series of shelves 130 inside the storage body 105, one above the other.

Figure 4:
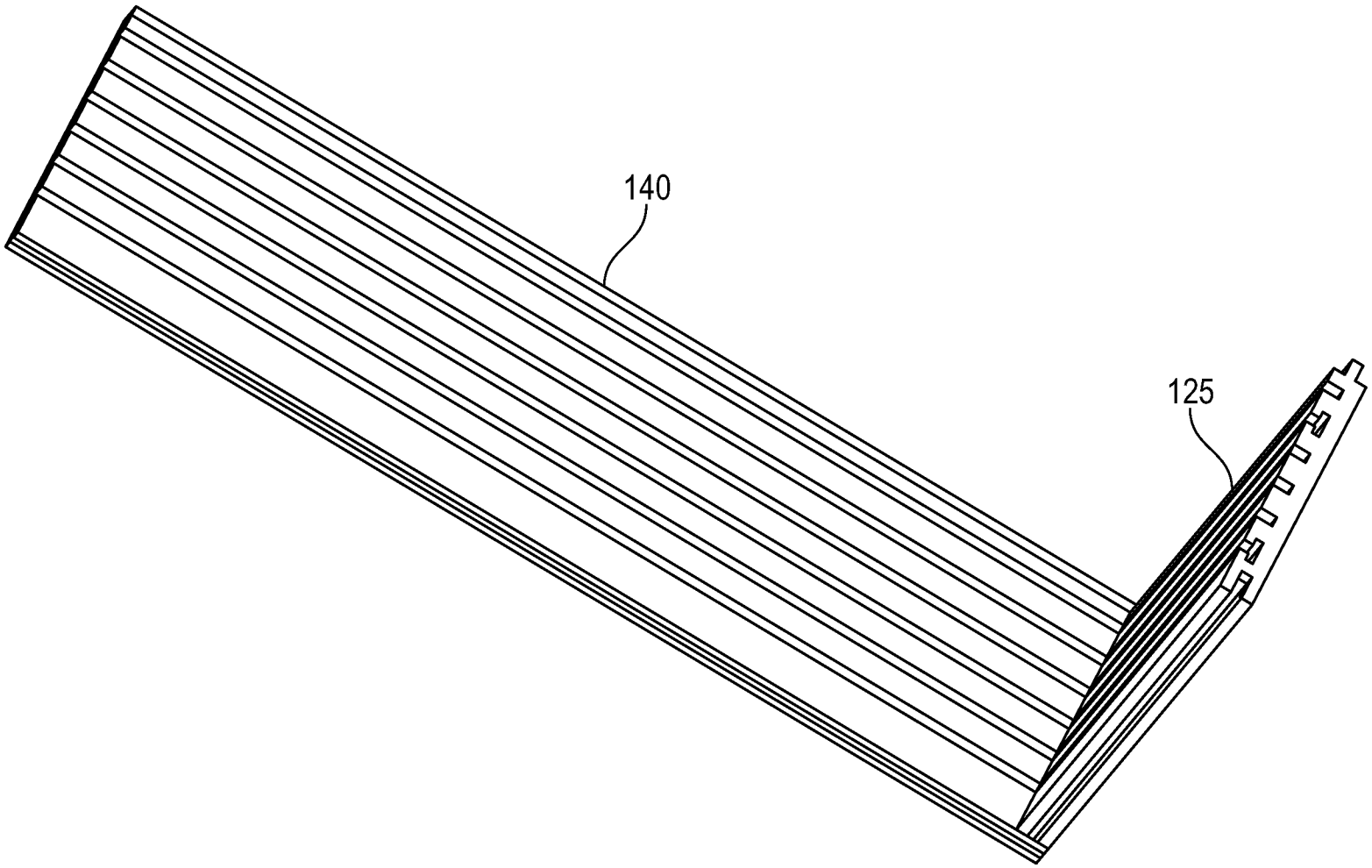
FIG. 4 depicts a connection between an end wall and a side wall, in accordance with the disclosed embodiments.
Figure 5A:
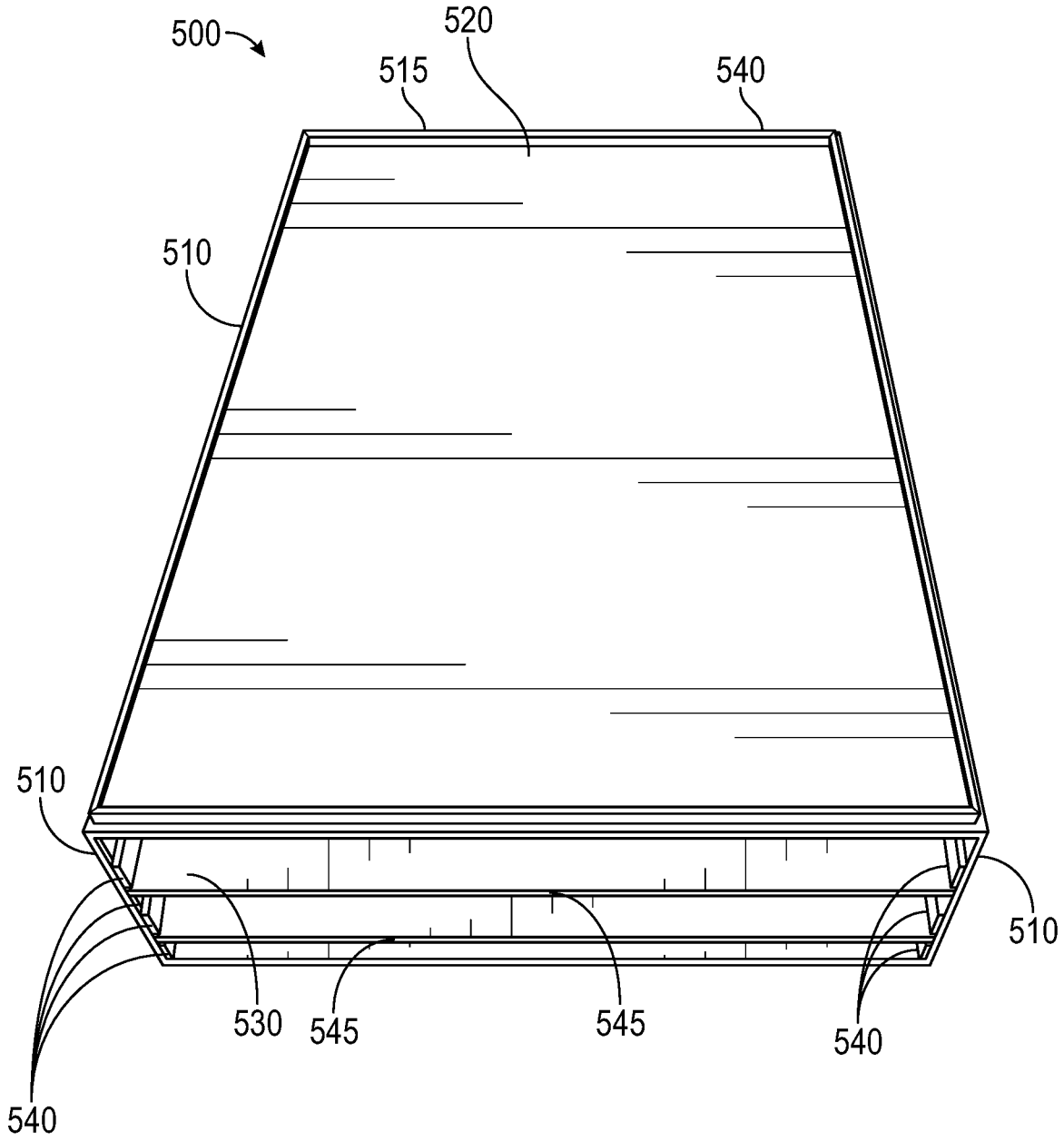
FIG. 5A depicts a top perspective view of a modular storage apparatus, in accordance with the disclosed embodiments.
Figure 5B:
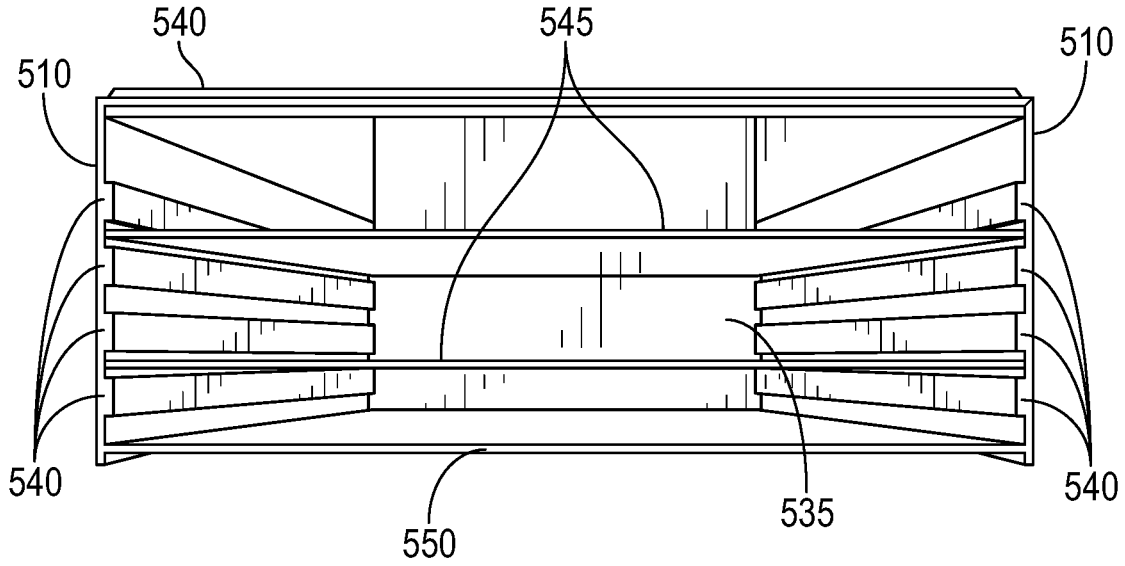
FIG. 5B depicts an elevation view of the front of a modular storage apparatus, in accordance with the disclosed embodiments.
Figure 5C:
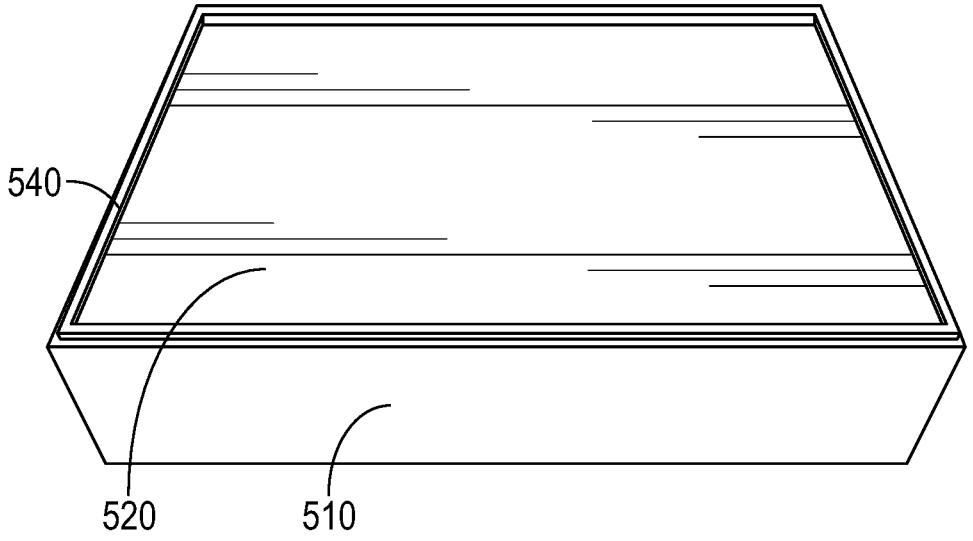
FIG. 5C depicts a perspective view of a modular storage apparatus, in accordance with the disclosed embodiments.
Figure 5D:
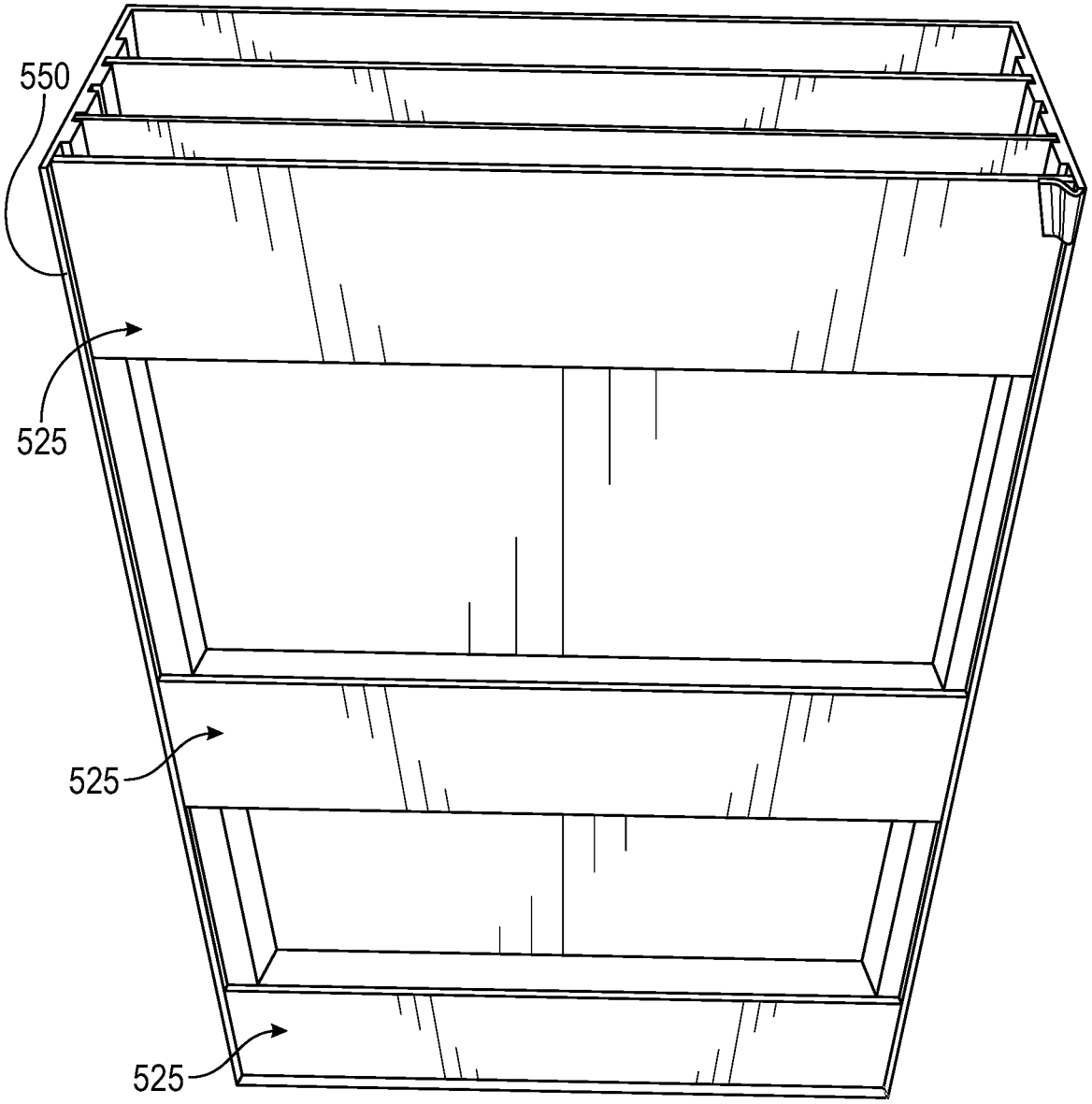
FIG. 5D depicts a bottom perspective view of a modular storage apparatus, in accordance with the disclosed embodiments.
Figure 6A:
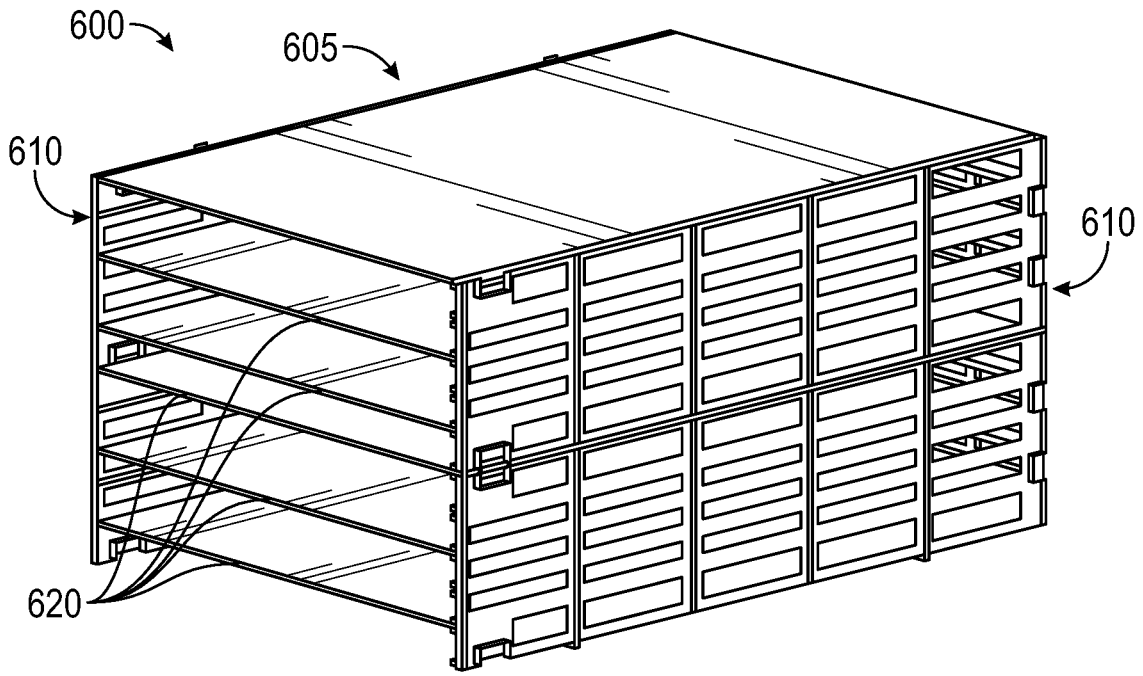
FIG. 6A depicts a front side perspective view of another embodiment of a modular storage apparatus, in accordance with the disclosed embodiments.
Figure 6B:
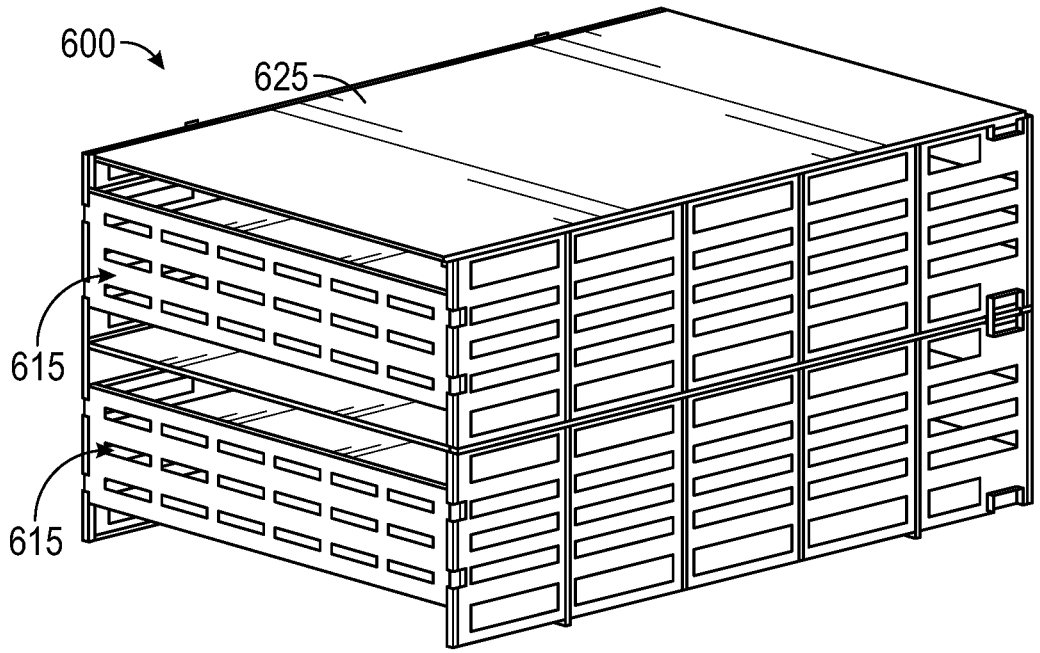
FIG. 6B depicts a rear side perspective view of another embodiment of a modular storage apparatus, in accordance with the disclosed embodiments.
Figure 6C:
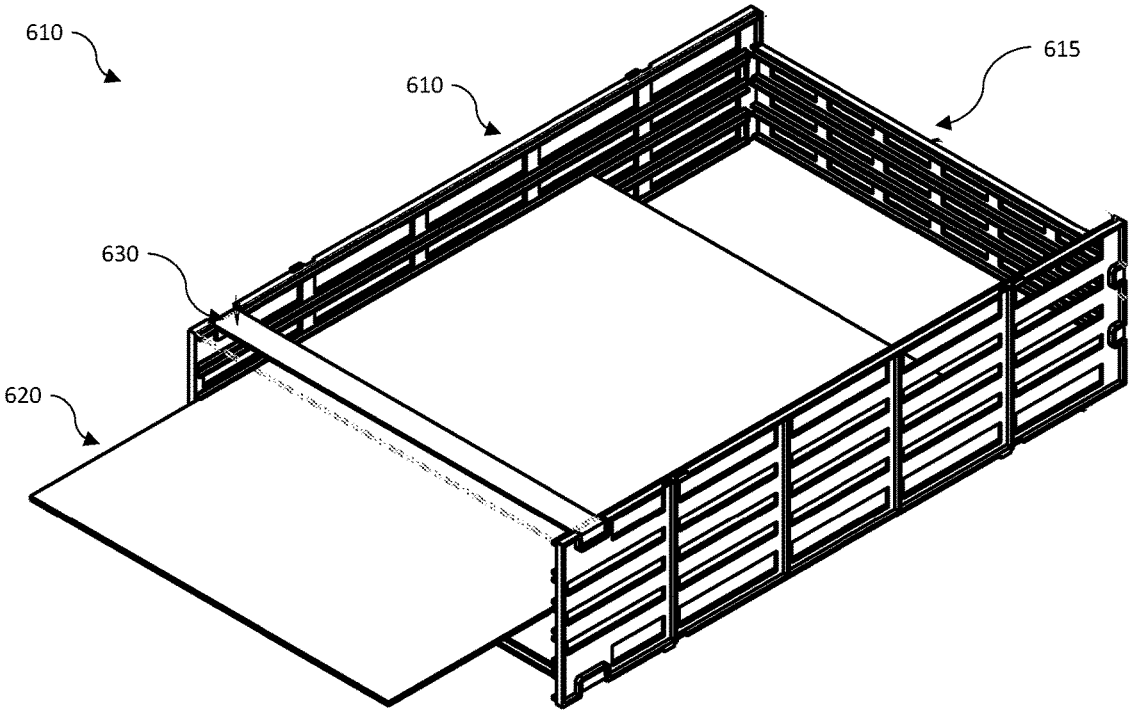
FIG. 6C depicts a top perspective view of another embodiment of a modular storage apparatus, in accordance with the disclosed embodiments.
Figure 6D:
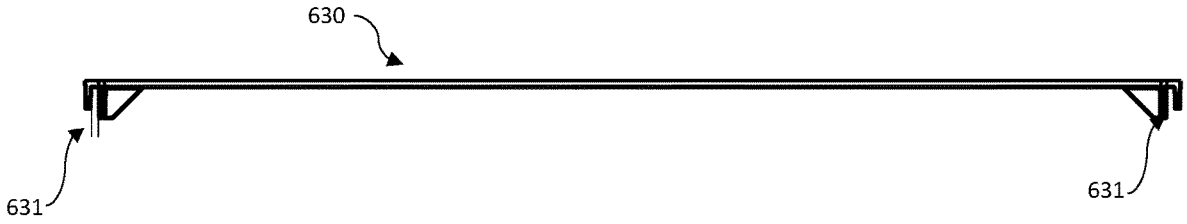
FIG. 6D depicts a spanner associated with a modular storage apparatus, in accordance with the disclosed embodiments.
Figure 6E:
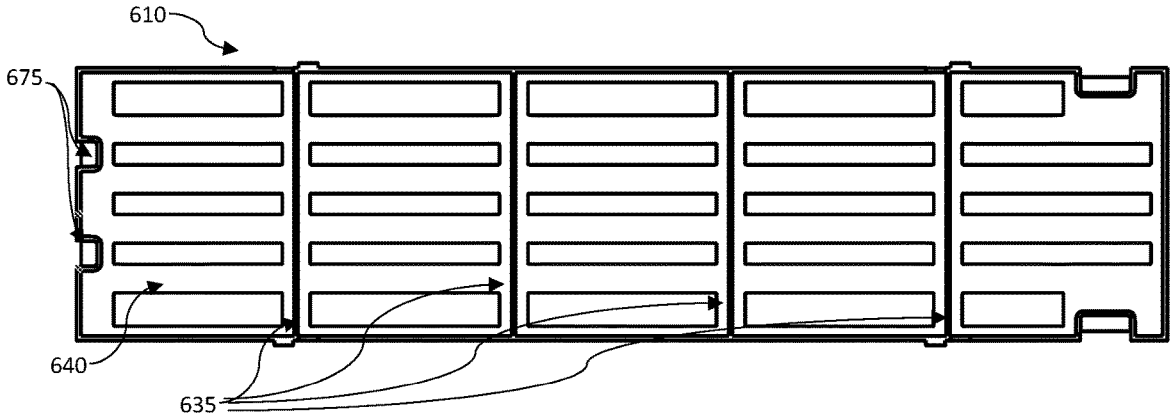
FIG. 6E depicts a side elevation view of a side wall associated with a modular storage apparatus, in accordance with the disclosed embodiments.
Figure 6F:
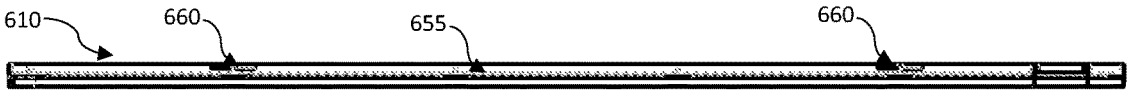
FIG. 6F depicts a top view of a side wall associated with a modular storage apparatus, in accordance with the disclosed embodiments.
Figure 6G:
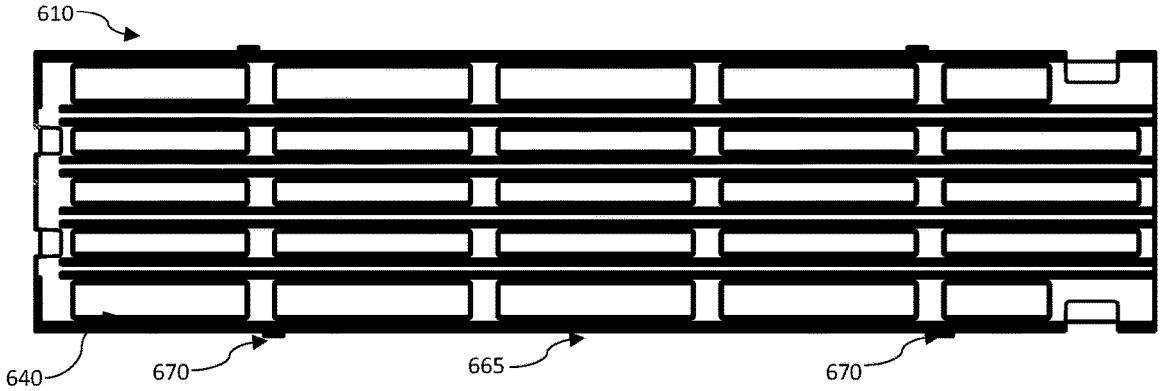
FIG. 6G depicts a side elevation view of the inner side of a side wall associated with a modular storage apparatus, in accordance with the disclosed embodiments.
Figure 6H:
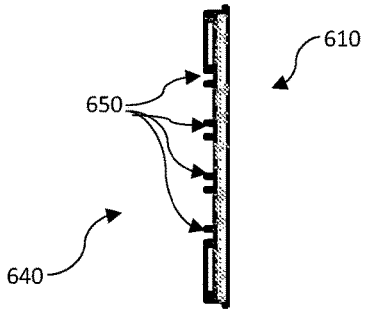
FIG. 6H depicts an elevation side view of the side wall associated with a modular storage apparatus, in accordance with the disclosed embodiments.
Figure 6I:
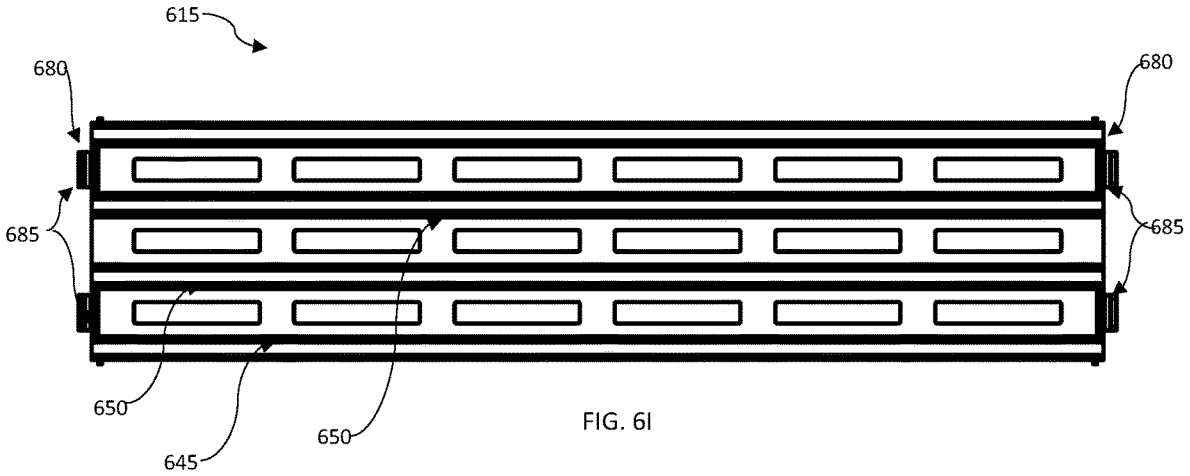
FIG. 6I depicts a side elevation view of an end wall associated with a modular storage apparatus, in accordance with the disclosed embodiments.
Figure 6J:
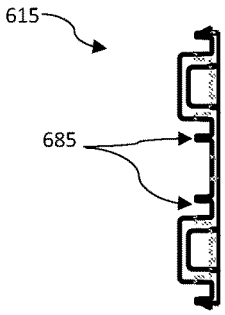
FIG. 6J depicts an elevation view of the distal end of the side wall associated with a modular storage apparatus, in accordance with the disclosed embodiments.

The storage body 105 can be assembled by inserting upper male connection pegs 335 extending from both ends of the end wall 120 into the upper connection grooves 215 of the first and second side walls 140, and by inserting lower male connection pegs 340 extending from both ends of the end wall 120 in the lower connection grooves 220 of the first and second side walls 140. This is illustrated in FIG. 4

In other embodiments, the two side walls 140 and end wall 120 could be manufactured in one piece. In other embodiments, the various pieces can be made by pre-drilling two holes in each of the side walls 140 connecting to the end wall 120 and pre-drilling both sides of the end wall 120 to accept the screws. The two side walls 140 and the end wall 120 can be pre-drilled with a CNC (computer numerical controlled) machine. The two side walls 140 and the end wall 120 can thus be joined with screws (e.g., 2 screws on each side), or with other such connectors.

The storage assembly 100 can further comprise at least one shelf 130 dimensionally configured to fit inside the storage body 105 in one of the sets of substantially coplanar grooves along the inner surface of the first side wall, second side wall, and end wall. In certain embodiments the number of shelves 130 can be selected to match the number of grooves configured to receive the shelves. The shelves are intended to be insertable and removable from the body by simply sliding them into place using the grooves as a guide and support. Thus, in certain embodiments, one or more of the shelves 130 can be selectively removed to accommodate the size requirements of the items stored in the storage assembly 100.

The storage assembly 100 can further comprise a top surface 145. In certain embodiments, the top surface 145 can comprise a removable shelf configured to fit in a set of coplanar top surface grooves 245 (also referred to as a top groove) formed in the first and second side walls, and a top surface groove 350 in end wall 120. In such an embodiment, the set of coplanar top surface grooves 245 formed in the first side wall and second side wall 140 are configured above the top mounting groove 215, and the top surface groove 250 in the end wall 120 is configured above the top mounting pegs 335.

In certain embodiments, the top surface 145 can have a set of 4 peg slots to be attached to the top surface of the side walls. These pegs will prevent any significant movement in the Y or Z planes. The top surface can be configured to mate with various accessories (spice racks, Lazy Susan, etc.) which can be attached in the peg slots designated for the shelf.

When the top surface 145 is inserted into the top surface mounting grooves the remaining edges of the side walls 140 and end wall 120 will form a lip 150 above the top surface 145. The lip 150 can help prevent items stored on the top of the top surface 145 from sliding off the top surface 145. The top surface 145 can further include a raised lip 150 on its outward facing edge to complete the circumferential lip around the top surface 145. In certain embodiments, all the shelves 130 can include a raised lip 150 on their outward facing edge to similarly prevent items stored thereon from slipping. In certain embodiments, this lip 150 can be optional so that shelf 130 can be inserted into the top groove to create the lip 150 or attached with the pegs and have no lip. The lip 150 can be configured on three sides so that items do not have to be lifted over the lip when removing them from the cabinet.

Accordingly, the storage body 105 can further comprise a top groove 245 formed along the inner surface of the first side wall 140 above the upper connection groove, a top groove 245 formed along the inner surface of the second side wall 140 above the upper connection groove 245, and a top groove 350 formed along the inner surface of the end wall 120 above the upper male connection peg 335. The top shelf 145 is then configured to fit inside the storage body 015 along the substantially coplanar top grooves 245 along the inner surface of the first side wall 140, the top grooves 245 along the inner surface of the second side wall 140, and the top grooves 350 along the inner surface of the end wall 120.

In certain embodiments, the storage body 105 can be configured to be modular, such that one complete storage assembly 100 can be stacked on another complete storage assembly 100. In certain embodiments, this can facilitate use of additional space in a large cabinet.

The storage body 105 can thus be configured with a raised edge or stacking raised edge extending from the top edge of the first side wall 140, a raised edge extending from the top edge of the second side wall 140, and a raised edge extending from the top edge of the end wall 120. The storage body 105 can further include mating or matching grooves extending along the bottom edge of the first side wall 140, the second side wall 140, and the end wall 120. The stacking edge is configured to fit into the matching grooves so that, in certain embodiments, a plurality of storage bodies, can be configured to stack one on top of the other. The system can have units attached along the joints, along the expansion slot, or both.

An advantageous aspect of the disclosed embodiments is that they are configured to be easy to assemble and can therefore be shipped and/or stored disassembled. The disassembled configuration can therefore be stored and/or shipped in a generally flat arrangement with each of the components laid on top of one another.

Assembly of the storage assembly can be made simple with the connection or mounting grooves formed in the side walls 140 (as illustrated in FIGS. 2A-2F) and the matching or interfacing connection pegs 335 formed in the end wall 120 (illustrated in FIGS. 3A-3E). A connection between one side wall 140 and an end wall 120 is illustrated in FIG. 4. It should be appreciated that a substantially identical connection mechanism can be used for the other side wall's connection to the end wall 120.

The connection pegs 335 in the end wall 120 are configured on the distal ends of the end wall 120. In certain embodiments, the end wall 120 can include two connection pegs 335 on each distal end, but other arrangements are also possible. Each connection peg 335 generally comprises a T-shaped extrusion with the end of the vertical leg of the T-shaped extrusion being flush with the inner surface of the end wall 120, and the lateral "cross" in the T-shaped extrusion being approximately in the middle of the distal end of the end wall 120.

The side walls 140 are configured with lower and upper connection grooves 215 and 220 which can comprise T-shaped cutouts in the side wall 140, the T-shaped cutouts being configured to be substantially coplanar with the associated connection pegs 335 in the end wall 120. Each side wall 140 can include at least as many connection grooves as there are connection pegs on one end of the end wall 120. For example, if each distal end of the end wall 120 includes an upper and lower connection peg, each of the side walls 140 can likewise include an upper and lower mounting groove.

In certain embodiments, the T-shaped cutouts of the upper and lower connection grooves 215 and 220 can be configured such that the bottom of the leg of the T-shaped cutout creates a linear channel in the inner surface of the side wall 140. The lateral "cross" in the T-shaped cutout is thus formed internally in the side wall 140. In one embodiment, the front facing distal end of the side wall 140 can have a T-shaped cutout that is sized to be slightly larger than the associated connection peg 335 in the end wall 120 such that the connection peg 335 can slide into the T-shaped cutout. In certain embodiments, the T-shaped cutout can run the length of the side walls 140 and then terminate just before the backward facing distal end of the side wall 140. In this way, the connection peg can slide into place in the connection groove but cannot be pushed out the back of the second side wall 120. In other embodiments, the connection groove can run the length of the second side wall 120 such that both distal ends of the side walls 140 have a T-shaped cutout.

Because the T-shaped cutouts run the length of the side walls 140, the storage assembly 100 can be sized with various depths. In such circumstances, the end wall 120 can be inserted into the side walls to a desired depth.

In certain embodiments, the storage assembly can be assembled at its final point of installation. The system can have joints to fit flush together and can optionally be connected with glue. A connection can then be made using one of: T connectors, L connectors, clips, snap fits, glue adhesives, dowels, rods, screws, nails, rivets, staples, bolts or another mechanical fastener to hold the joint together. In certain embodiments, elements of the system can be butt jointed and have one of the following: T connectors, L connectors, clips, snap fits, glue, adhesives, dowels, rods, screws, nails, rivets, staples, bolts or another mechanical fastener.

In certain embodiments aspects of the body 105 can be connected with dovetails formed on the body 105, that slot into 2 side walls and hold the storage assembly 100 at a constant width. The storage assembly can have a bracket that holds either the front side or top (particularly if stacked) at a constant width.

In certain embodiments, the entire system or assembly can be configured as a square base comprising two parallel sides with a center indent or a center ridge to which the side walls attach. The third side can have another center indent or center ridge which can attached to the back wall.

The side walls are designed to accept shelves via grooves. However, in certain embodiments, the grooves could be replaced with, rails, or a sliding rail system. In the case of the sliding rail system, the shelves can be configured with wheels that follow channels formed in the rail system. Support for these rails is provided by the end wall and any accessories or variations in positioning (e.g., hanging in the cabinet) can be mounted mainly or entirely by the end wall 120 with support on the side walls 140. This is a function of the possible size restrictions in the width but not depth. Side walls 140 can also be configured with stubs on the bottom which can raise the storage assembly 100 off the cabinet floor.

The end wall 120 can serve as a structural support, stacking support, and shelf support. If the storage assembly 100 is to be hung inside a cabinet, or if the storage assembly is combined with additional accessories, the end wall 120 can use the ridge on the wall to do so. This ridge could also be replaced with making the wall thicker and have outside attachment grooves. The end wall could also have stubs on the bottom of the unit (like legs but very short) that would raise the storage assembly 100 off the cabinet floor at the same height as the side walls 140.

The shelves 130 can be cut from stock sheets or extruded and then cut to size to fit the grooves and width of the storage body 105. The shelves 130 can have corners cut (either straight or circular) on the back side for addition space for different connections. The shelves 130 can have one or more small oval or circular cuts in the center front for easy pull out.

In certain embodiments, the storage assembly 100 can further include an expansion slot on the end wall 120 that acts, as a structural point for stacking, but can also be used to anchor other accessories such as a spice rack, Lazy Susan, pullout pot rack, etc., to the storage assembly 100. The inside of the side walls 140 can be outfitted with accessories such as an LED light or series of LED lights 255 to brighten the inside of the storage assembly 100 and cabinet. The front of the shelves can have small tabs for putting labels of what is on each shelf.

In certain embodiments, the storage assembly 100 can be configured to be hung upside down and attached to rails on the cabinet side walls. This allows shelves to be slid in and out and rearranged. In certain embodiments, the storage assembly 100 can be placed in a bathroom vanity under the plumbing. It can also be used in a garage, pantry, closet or other storage space for the storage of other household items which are long, thin, or otherwise not convenient to store in a standard cabinet. Other kitchen installations include on countertops, on top of the refrigerators, etc.

FIGS. 5A-5D illustrates another embodiment of a modular storage apparatus 500. In the embodiment illustrated in FIGS. 5A-5D, the storage body 505 can comprise a single molded piece. The body 505 is configured with two side walls 510, an end wall 515, a top 520, bottom slats 525, and with an open front face 530. The inside 535 of the body 505 includes molded lips 540. The spaces between the lips 540 create a series of channels on the side walls 510. The lips 540 on one respective side wall 510 are configured to be substantially coplanar with the lips 540 on the opposing side wall 510 so that the channels formed by the lips are also substantially coplanar. A shelf 545 can be inserted into each of the channels to store various items.

The bottom 550 of the storage body 505 can include one or more bottom slats 525. The bottom slats 525 are provided so that the system can be set over permanent or semi-permanent fixtures. Such fixtures could include, for example, plumbing fixtures in a lower cabinet. In addition, the slats 525 ease access to the internal surfaces of the body 505 for cleaning. In an alternative embodiment (not shown), the bottom of the storage body 505 can be a single piece enclosing the entire bottom of the storage body 505.

In either case, the bottom of the storage body 505 can be slightly recessed as referenced against the side walls and end wall such that a side walls and end walls extend slightly lower than the bottom of the storage body, forming a lip 550.

The top surface 520 of the body 505 is configured with a retaining lip 540. The retaining lip 540 can follow the outer perimeter of the top surface 520 but can be inset from the true perimeter of the top surface 520. The retaining lip 540 serves two functions. The first is to prevent items stored on the top surface from slipping off the surface.

The second is based on the modular nature of the storage apparatus 500. A second storage apparatus 500 can be stacked on top of the first storage apparatus 500. The inset of the retaining lip 540 can be selected to be slightly greater than the thickness of the side walls 510 and end walls 515 so that the lip 550 formed by the side walls 510 and end walls 515 on the bottom of storage apparatus 500 can fit over the retaining lip 540 on the top 520 of another storage apparatus 500. The retaining lip 550 thus prevents the upper storage apparatus 500 from sliding off the lower storage apparatus 500 on which it is stacked.

FIGS. 6A-6J Illustrate another embodiment of a lightweight storage assembly 600 in accordance with the disclosed embodiments. The assembly 600 includes a storage body 605. The storage body 605 is formed from the connection of two slatted sidewalls 610 with an end support 615. A series of shelves 620 can be fitted between the slatted sidewalls 610. The storage body 605 further includes a top surface 625. The lightweight storage assembly 600 further includes a spanner 630 configured to fit between the two slatted sidewalls 610. The spanner 630 includes wall snapper 631.

Each of the sidewalls 610 can comprise a series of support risers 635 molded in a sheet configured with a series of horizontal slats 640. The inside surface 645 of the sidewalls 610 can further comprise paired ribs 650. The paired ribs 650 form a channel configured to receive one of the shelves 620. The paired ribs 650 can be formed along the horizontal slats 640.

The top surface 655 of the sidewalls 610 can include mounting slots 660. The bottom surface 665 of the sidewalls 610 can include mounting tabs 670. The mount tabs 670 are configured to fit into the mounting slots 660, so that the storage assemblies can be stacked on top of the next. The rear surface of the sidewalls 610 can further be fitted with snap connection slots 675 for connection to the end support 615.

The end support 615 can similarly include a series of support risers 635 molded in a sheet configured with a series of horizontal slats 640. The inside surface 645 of the sidewalls 610 can further comprise paired ribs 650. The paired ribs 650 form a channel configured to receive one of the shelves 620. The paired ribs 650 can be formed along the horizontal slats 640. The distal ends 680 of the end support 615 can include snap tabs 685 configured to fixedly engage the mounting slots 660.

Figure 7A:
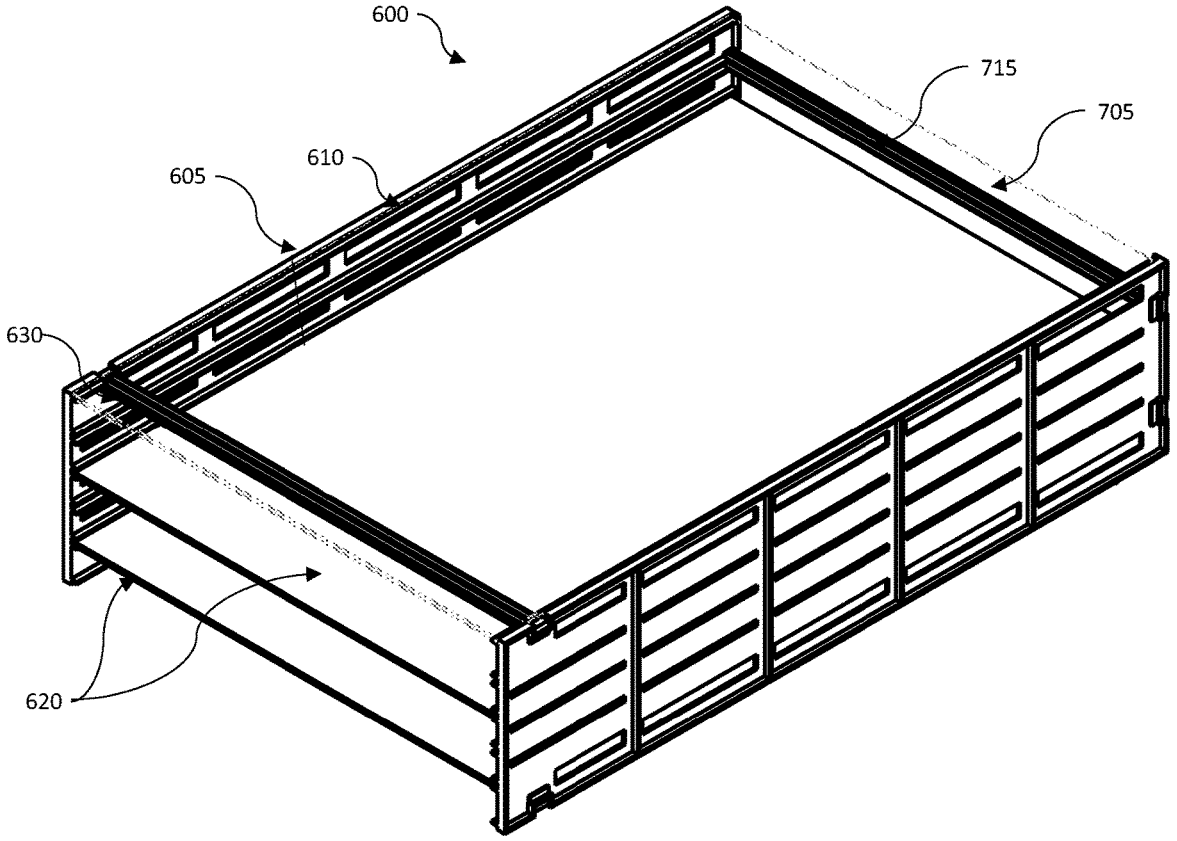
FIG. 7A depicts a front side perspective view of another embodiment of a modular storage apparatus, in accordance with the disclosed embodiments.
Figure 7B:
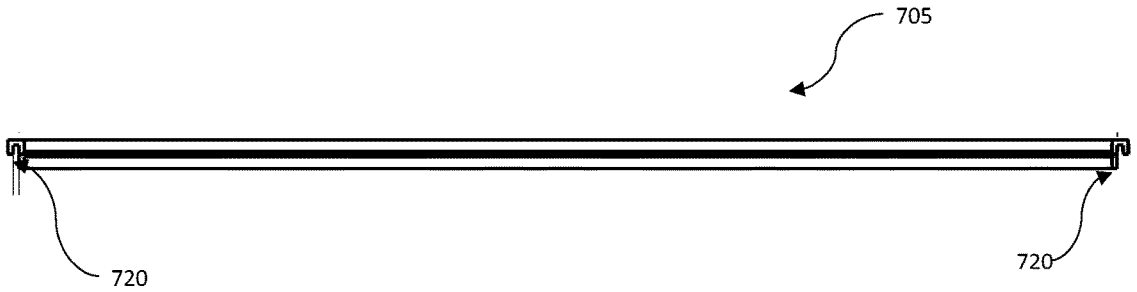
FIG. 7B depicts a spanner, in accordance with the disclosed embodiments.
Figure 7C:
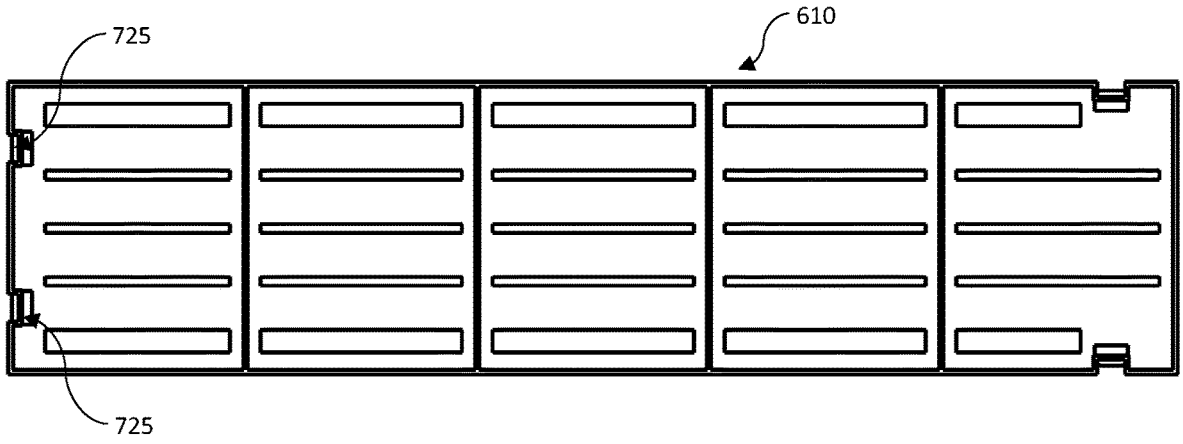
FIG. 7C depicts an elevation side view of the side wall associated with a modular storage apparatus, in accordance with the disclosed embodiments.
Figure 8A:
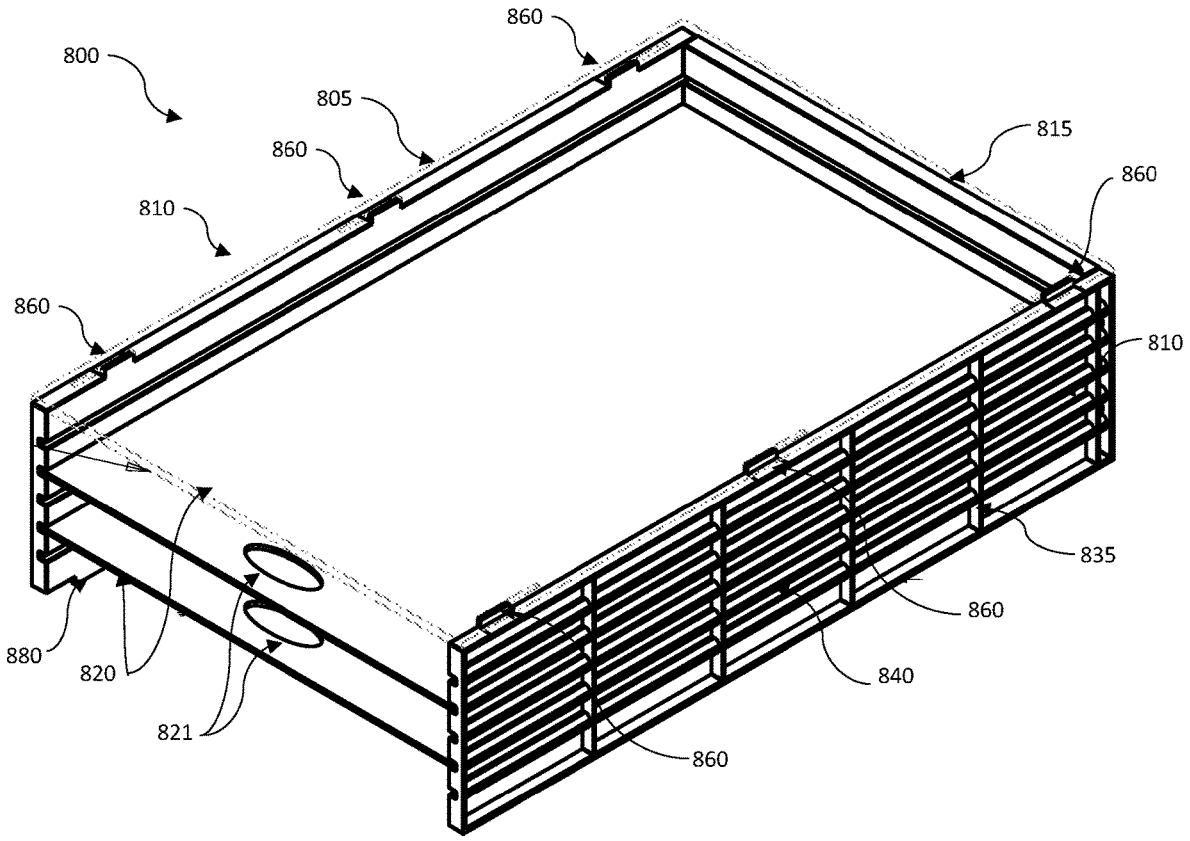
FIG. 8A depicts a front side perspective view of another embodiment of a modular storage apparatus, in accordance with the disclosed embodiments.
Figure 8B:
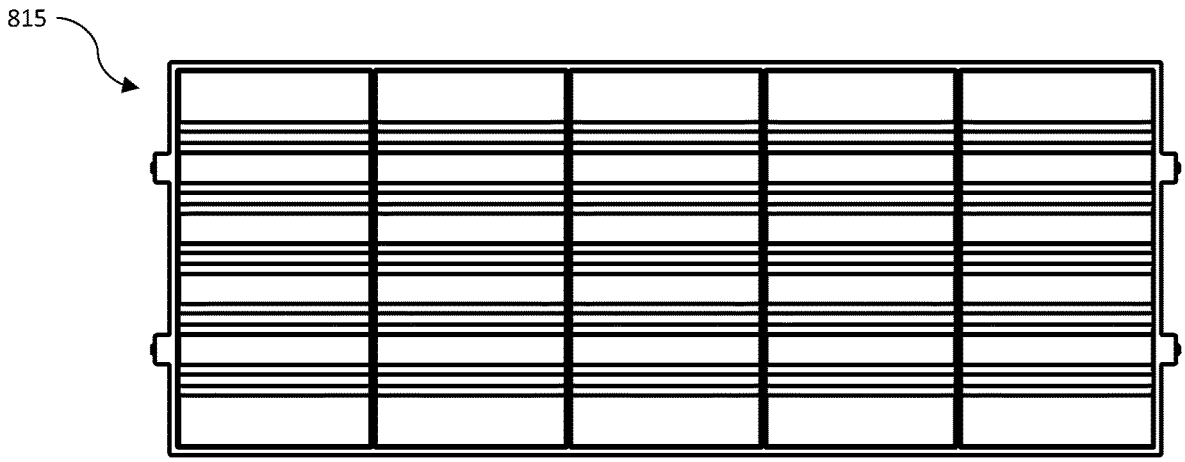
FIG. 8B depicts side wall associated with a modular storage device, in accordance with the disclosed embodiments.
Figure 8C:
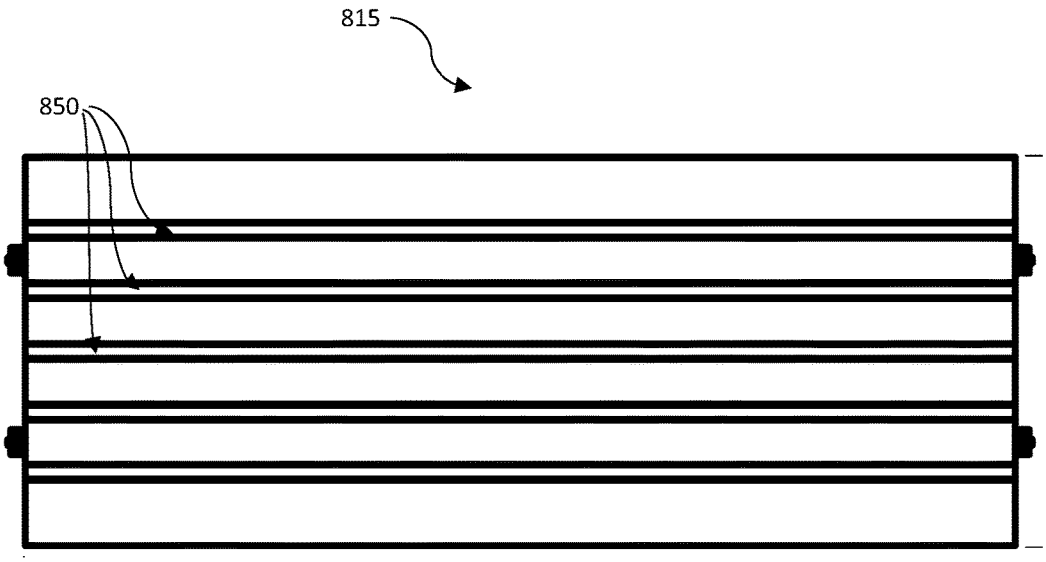
FIG. 8C depicts an inside of a side wall associated with a modular storage device, in accordance with the disclosed embodiments.
Figure 8D:
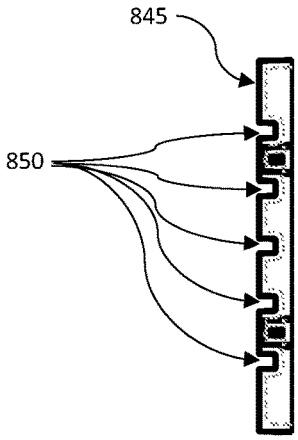
FIG. 8D depicts an elevation view of the distal end of the side wall associated with a modular storage apparatus, in accordance with the disclosed embodiments.
Figure 8E:
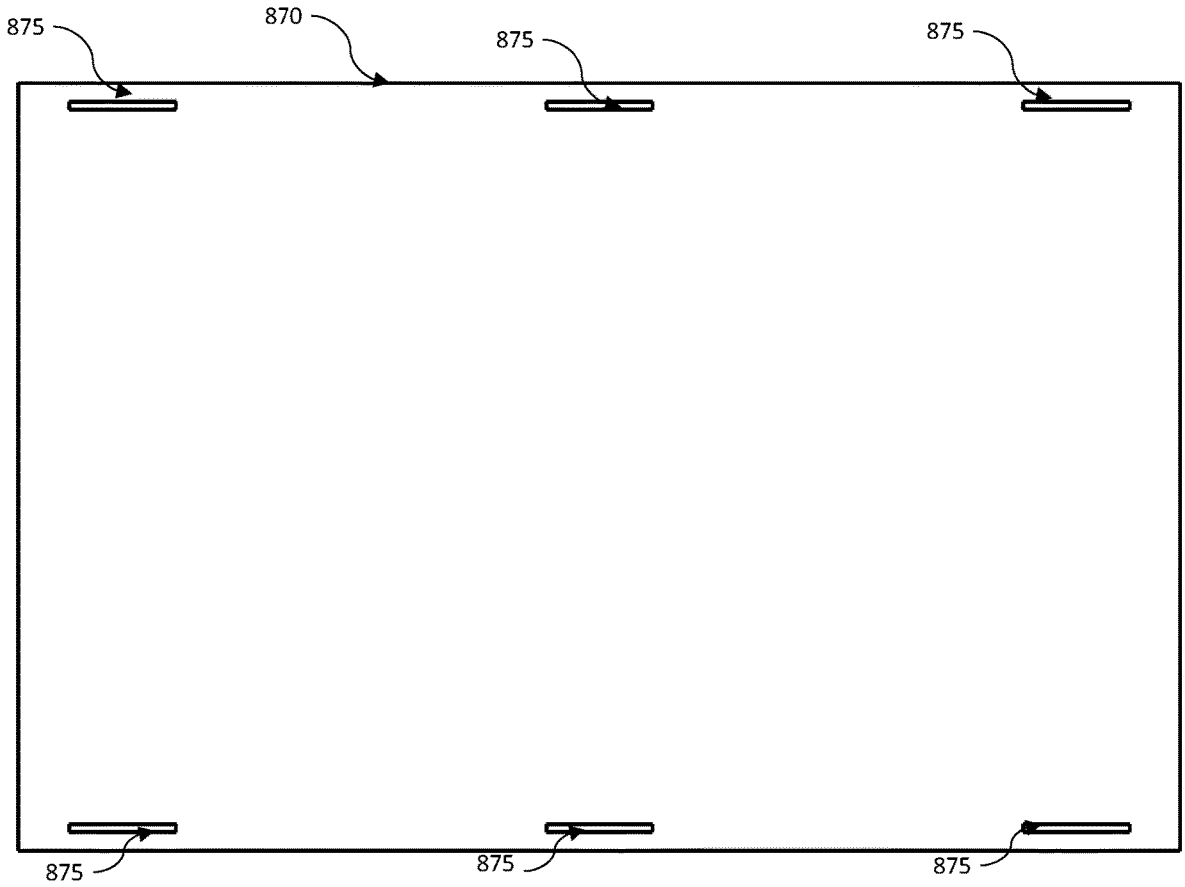
FIG. 8E depicts a bottom surface associated with a modular storage apparatus, in accordance with the disclosed embodiments.

FIGS. 7A-7C illustrate another embodiment of a lightweight storage assembly 600 in accordance with the disclosed embodiments. The assembly 600 includes a storage body 605. The storage body 605 is formed from the connection of two slatted sidewalls 610 with end supports 705. The end supports 705 can comprise support spanners 710. The support spanners 710 can comprise a bar with paired ribs 715. The paired ribs 715 form a channel configured to receive one of the shelves 620. The distal ends of the support spanners 710 can be fitted with snap tabs 720 configured to fixedly engage mounting slots 725 on the sidewalls 610.

Accordingly, the disclosed embodiments relate to a storage solution for large and bulky bakeware that minimizes functional obsolescence while maximizing the use of cabinet space. The embodiments are designed to be easy to use. The unit can be easily assembled and disassembled for shipping or storage purposes. After assembly, the shelves slide in and out with ease. The height between the shelves can also be adjusted. Having shelves that slide out improves access to all levels of the space. The disclosed embodiments reduce wasted cabinet space and can serve as a new or false bottom for the cabinet.

FIGS. 8A-8E Illustrate another embodiment of a lightweight storage assembly 800 in accordance with the disclosed embodiments. The assembly 800 includes a storage body 805. The storage body 805 is formed from the connection of two sidewalls 810 with an end support 815. A series of shelves 820 can be fitted between the sidewalls 810.

Each of the sidewalls 810 can comprise a series of support risers 835 and support cross beams 840 molded in a sheet. The inside surface 845 of the sidewalls 810 can further comprise slots 850. The slots 850 form a channel configured to receive one of the shelves 820. The slots 850 can be formed along the inside surface 845.

The top rim 855 of the sidewalls 810 can include mounting tabs 860. The mount tabs 860 are configured, so that the storage assemblies can be stacked on top of the next. The end support 815 can similarly include a series of support risers 835 and crossbeams 840 molded in a sheet. The inside surface 645 of the sidewalls 610 can further comprise slots 850. Slots 850 form a channel configured to receive one of the shelves 820. The shelves 820 illustrated in FIG. 8A included pull cutouts 821. The pull cutouts 821 improve the ease with which a user can grip and slide the shelf 820.

The storage body 805 further includes a bottom sheet 870. The bottom sheet 870 can be configured with a plurality of mounting slots 875. The mounting slots are configured to accept mounting strips 880 configured on the sidewalls 810. In embodiments, where one system is stacked on another, the mounting slots 875 can be inserted over the mount tabs 860 configured on the top edge of the sidewalls 810.

Immediate applications include, but are not limited to storage of large bakeware such as pans and platters, while also allowing complete use of cabinet space, as the top of the unit can serve as a false bottom of the cabinet. The disclosed shelves can be easily adjusted to different predetermined heights so that bakeware of almost any size can be stored. The connection on the top of every piece also serves as a lip to stop objects from falling off and/or spills from leaking over the edge into the cabinet. The pieces also allow two orientations, providing more options for where to put the unit. Finally, the size of the assembled unit can be both adjustable and optimized to fit as many potential locations as possible.

Thus, aspects of the embodiments are designed to provide a storage solution space by having wide openings in the horizontal plane for storing large, wide, and deep bakeware. Aspects include solutions for large lower cabinets by providing storage space and a "faux bottom" so that the entire cabinet above the unit can be used Based on the foregoing, it can be appreciated that a number of embodiments, preferred and alternative, are disclosed herein.

For example, in certain embodiments, a storage apparatus comprises at least one storage body comprising: a first side wall, the first side wall comprising at least two grooves along an inner surface of the first side wall; a lower connection groove formed below the at least two grooves, and an upper connection groove formed above the at least two grooves; a second side wall, the second side wall comprising at least two grooves along an inner surface of the second side wall; a lower connection groove formed on the inner surface of the second side wall and below the at least two grooves, and an upper connection groove formed on the inner surface of the second side wall and above the at least two grooves; an end wall, the end wall comprising at least two grooves along an inner surface of the end wall; an upper male connection peg extending from both ends of the end wall and configured to fit in the upper connection groove of the first side wall and the upper connection groove of the second side wall respectively; and a lower male connection peg extending from both ends of the end wall and configured to fit in the lower connection groove of the first side wall and the lower connection groove of the second side wall respectively; wherein each of the at least two grooves along the inner surface of the first side wall, the at least two inner grooves along the inner surface of the second side wall; and the at least two inner grooves along the inner surface of the end wall are substantially coplanar; and at least one shelf configured to fit inside the storage body along the substantially coplanar grooves along the inner surface of the first side wall, the grooves along the inner surface of the second side wall; and the grooves along the inner surface of the end wall. In an embodiment, the storage body further comprises a top surface configured to fit on top of the first side wall, second side wall, and end wall.

In an embodiment, the storage body further comprises a top groove formed along the inner surface of the first side wall above the upper connection groove, a top groove formed along the inner surface of the second side wall above the upper connection groove, a top groove formed along the inner surface of the end wall above the upper male connection peg, wherein the top groove formed along the inner surface of the first side wall, the top groove formed along the inner surface of the second side wall, and the top groove formed along the inner surface of the end wall are substantially coplanar, and a top shelf configured to fit inside the storage body along the substantially coplanar top grooves along the inner surface of the first side wall, the top grooves along the inner surface of the second side wall, and the top grooves along the inner surface of the end wall. In an embodiment, the apparatus further comprises a raised edge extending from a top edge of the first side wall, a raised edge extending from a top edge of the second side wall, and a raised edge extending from a top edge of the end wall. In an embodiment the apparatus further comprises a groove extending along a bottom edge of the first side wall, a groove extending along a bottom edge of the second side wall, and a groove extending along a bottom edge of the end wall.

In an embodiment the at least one storage body comprises a plurality of storage bodies, the plurality of storage bodies being configured to stack one on top of the other. In an embodiment, the at least one shelf further comprises a cutout along a forward facing edge, the cutout being configured to allow the at least one shelf to be pulled out. In an embodiment, the at least one storage body is configured to store kitchenware. In an embodiment, the storage apparatus further comprises a bottom, the bottom comprising at least two bottom slats.

In another embodiment, a storage assembly comprises at least one storage body comprising a first side wall, a second side wall, an end wall, and at least two grooves along an inner surface of the first side wall, an inner surface of the second side wall and an inner surface of the end wall, the grooves being substantially coplanar, and at least one shelf configured to fit inside the storage body along the substantially coplanar grooves.

In an embodiment, the first side wall comprises a slatted sidewall further comprising a plurality of support risers molded in a sheet and the second side wall comprises a slatted sidewall further comprising a plurality of support risers molded in a sheet. In an embodiment, the first slatted sidewall further comprises a plurality of horizontal slats and the second slatted sidewall further comprises a plurality of horizontal slats.

In an embodiment, the storage assembly further comprises a first pair of ribs in the first side wall and the second side wall forming one of the at least two grooves and a second pair of ribs in the first side wall and the second side wall forming one of the at least two grooves. In an embodiment, the storage assembly further comprises a spanner formed between the first side wall and the second side wall.

In another embodiment, a storage system comprises at least one storage body comprising a first side wall, the first side wall comprising at least two grooves along an inner surface of the first side wall; a lower connection groove formed below the at least two grooves, and an upper connection groove formed above the at least two grooves, a second side wall, the second side wall comprising at least two grooves along an inner surface of the second side wall; a lower connection groove formed on the inner surface of the second side wall and below the at least two grooves, and an upper connection groove formed on the inner surface of the second side wall and above the at least two grooves, an end wall, the end wall comprising at least two grooves along an inner surface of the end wall; an upper male connection peg extending from both ends of the end wall and configured to fit in the upper connection groove of the first side wall and the upper connection groove of the second side wall respectively; and a lower male connection peg extending from both ends of the end wall and configured to fit in the lower connection groove of the first side wall and the lower connection groove of the second side wall respectively and a bottom, the bottom comprising at least two bottom slats, wherein each of the at least two grooves along the inner surface of the first side wall, the at least two inner grooves along the inner surface of the second side wall; and the at least two inner grooves along the inner surface of the end wall are substantially coplanar, and at least one shelf configured to fit inside the storage body along the substantially coplanar grooves. In an embodiment, the storage body further comprises a top surface configured to fit on top of the first side wall, second side wall, and end wall.

In an embodiment, the storage system further comprises a raised edge extending from a top edge of the first side wall, a raised edge extending from a top edge of the second side wall, and a raised edge extending from a top edge of the end wall. In an embodiment, the first side wall comprises a slatted sidewall further comprising a plurality of support risers molded in a sheet, and the second side wall comprises a slatted sidewall further comprising a plurality of support risers molded in a sheet. In an embodiment, the first slatted sidewall further comprises a plurality of horizontal slats and the second slatted sidewall further comprises a plurality of horizontal slats.

In an embodiment, the storage system further comprises a plurality of lights formed on the at least one storage body.

It will be appreciated that variations of the above-disclosed and other features and functions, or alternatives thereof, may be desirably combined into many other different systems or applications. Also, it should be appreciated that various presently unforeseen or unanticipated alternatives, modifications, variations or improvements therein may be subsequently made by those skilled in the art which are also intended to be encompassed by the following claims.

What is claimed is:

1. A storage apparatus comprising:

at least one storage body comprising:

a first side wall, the first side wall comprising at least two grooves along an entire length of an inner surface of the first side wall; a lower T-shaped connection groove formed along the entire length of the inner surface of the first side wall below the at least two grooves, and an upper T-shaped connection groove formed along the entire length of the inner surface of the first side wall above the at least two grooves;

a second side wall, the second side wall comprising at least two grooves along an entire length of an inner surface of the second side wall; a lower T-shaped connection groove formed along the entire length of the inner surface of the second side wall below the at least two grooves of the second side wall, and an upper T-shaped connection groove formed along the entire length of the inner surface of the second side wall above the at least two grooves of the second side wall;

an end wall, the end wall comprising at least two grooves along an entire length of an inner surface of the end wall; an upper male T-shaped connection peg extending from both ends of the end wall and configured to fit in the upper T-shaped connection groove of the first side wall and the upper T-shaped connection groove of the second side wall respectively; and a lower male T-shaped connection peg extending from both ends of the end wall and configured to fit in the lower T-shaped connection groove of the first side wall and the lower T-shaped connection groove of the second side wall respectively;

wherein each of the at least two grooves along the inner surface of the first side wall, the at least two grooves along the inner surface of the second side wall; and the at least two grooves along the inner surface of the end wall are substantially coplanar;

a stacking edge along a top edge of the first side wall, and a stacking groove along a bottom edge of the first side wall; and a stacking edge along a top edge of the second side wall, and a stacking groove along a bottom edge of the second side wall; and at least one shelf configured to fit inside the at least one storage body along the substantially coplanar grooves along the inner surface of the first side wall, the grooves along the inner surface of the second side wall; and the grooves along the inner surface of the end wall.

2. The storage apparatus of claim 1 wherein the at least one storage body further comprises:

a top surface configured to fit on top of the first side wall, second side wall, and end wall.

3. The storage apparatus of claim 1 wherein the at least one storage body further comprises:

a top groove formed along the entire length of the inner surface of the first side wall above the upper T-shaped connection groove of the first side wall;

a top groove formed along the entire length of the inner surface of the second side wall above the upper T-shaped connection groove of the second side wall;

a top groove formed along the inner surface of the end wall above the upper male connection peg;

wherein the top groove formed along the inner surface of the first side wall, the top groove formed along the inner surface of the second side wall, and the top groove formed along the inner surface of the end wall are substantially coplanar; and a top shelf configured to slide inside the storage body along the substantially coplanar top grooves along the inner surface of the first side wall, the top grooves along the inner surface of the second side wall, and the top grooves along the inner surface of the end wall.

4. The storage apparatus of claim 3 further comprising:

a raised edge extending from a top edge of the end wall.

5. The storage apparatus of claim 3 further comprising:

a groove extending along a bottom edge of the end wall.

6. The storage apparatus of claim 1 wherein the at least one storage body comprises a plurality of storage bodies, the plurality of storage bodies being configured to stack one on top of the other.

7. The storage apparatus of claim 1 wherein the at least one storage body is configured to store kitchenware.

* * * * *